United States Patent [19]

Feldberg et al.

[11] Patent Number: 4,676,576

[45] Date of Patent: Jun. 30, 1987

[54] COMMUNICATIONS CONNECTOR

[75] Inventors: Leonard Feldberg, Spring Valley, N.Y.; Dennis Williams, Norwalk, Conn.

[73] Assignee: Burndy Corporation, Norwalk, Conn.

[21] Appl. No.: 831,223

[22] Filed: Feb. 19, 1986

[51] Int. Cl.[4] ..... H01R 4/24

[52] U.S. Cl. ..... 439/404; 439/620

[58] Field of Search ..... 339/97 R, 97 P, 98, 339/99 R, 147 R, 147 P

[56] References Cited

U.S. PATENT DOCUMENTS

| | | | |
|---|---|---|---|
| 4,275,374 | 6/1981 | Chaucer | 339/99 R |
| 4,442,594 | 4/1984 | Narozmy | 339/99 R |
| 4,470,655 | 9/1984 | Kalka et al. | 339/99 R |

*Primary Examiner*—Joseph H. McGlynn

*Attorney, Agent, or Firm*—Perman & Green

[57] ABSTRACT

A preformed electrical insulation displacement connector enabling electrical continuity between telecommunications equipment whose multiple electrical leads are commonly on a 0.085 inch pitch (center line distance between conductors) and other types of electronic equipment whose multiple electrical leads are commonly on a 0.050 inch pitch. A pair of 25 conductor arrays are preformed for rapid and facile assembly assuming upper and lower rows in an insulative housing. Contacts are mounted at the forward end of the housing so they assume the 0.085 inch pitch and can be engaged by a conventional multiple contact plug and bifurcated tails are mounted at the aft end of the housing to engagingly receive successive leads of a conventional ribbon cable which has a 0.050 inch pitch. If desired, the housing can accommodate a plural contact capacitor filter array adapted to be electrically engaged by the conductor arrays. One or more brackets composed of electrically conductive spring material serve to ground the capacitor filter array. In one embodiment, such a bracket also serves to hold the array fixed in position within the housing. A cover removably mounted on the housing serves to engage the ribbon cable at the aft end of the housing and to hold it firmly in position against the bifurcated tails.

55 Claims, 28 Drawing Figures

FIG. 1.
FIG. 5
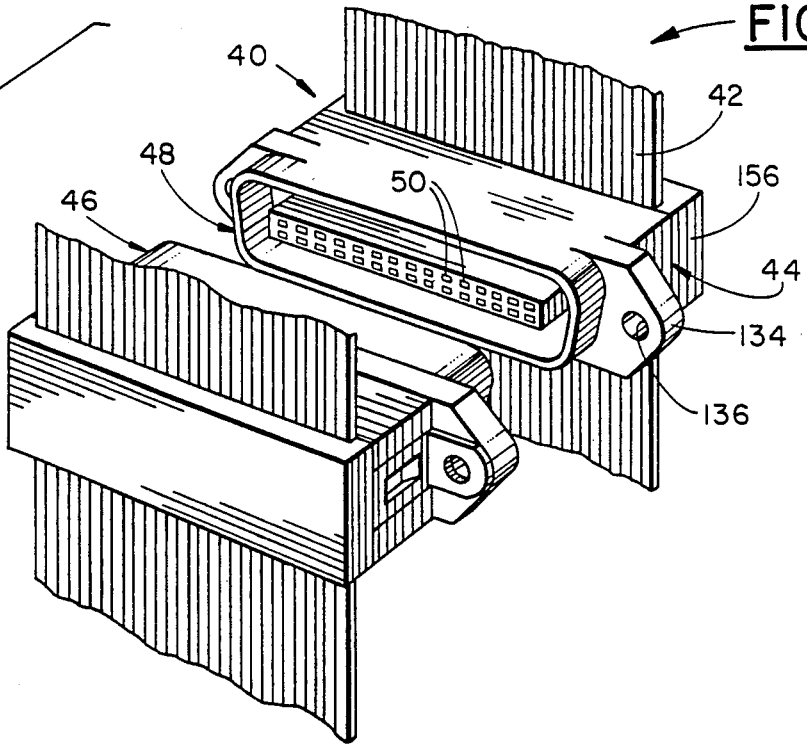
FIG. 4.
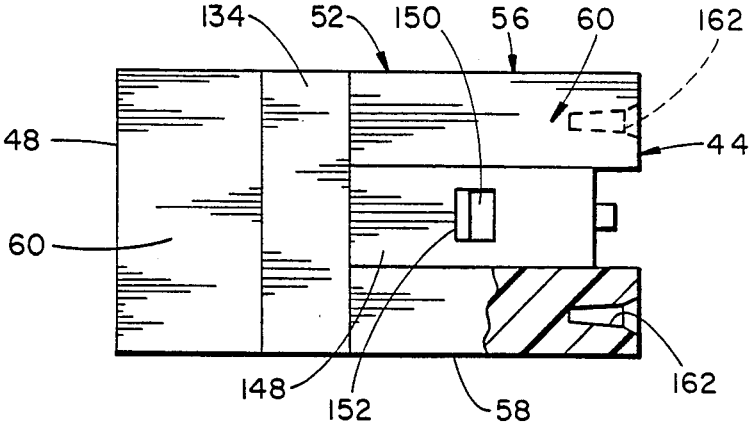
FIG. 13.
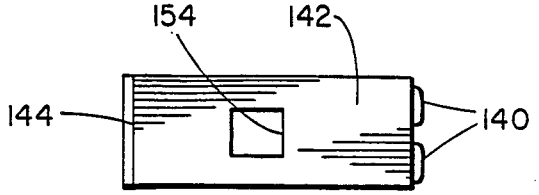

COMMUNICATIONS CONNECTOR

BACKGROUND OF THE INVENTION

1. Field of the Invention

The invention relates generally to connectors adapted to join electrical or electronic components having aligned multiple contacts of different pitches and, more particularly, to an improved type IEEE 488-D communications connector which can be readily and inexpensively manufactured.

2. Description of the Prior Art

With the widespread growth of both the electronics and telecommunications industries, and with the concomitant need to electrically connect a variety of electrical or electronic components with telecommunications equipment, there has been a significant demand for connectors which serve the purpose. However, historically, the telecommunication industry has customarily used a pitch of 0.085 inches, that is the centerline to centerline distance between adjacent conductors, in their input and output connectors. In contrast, most others in the electronic industry who utilize mass termination techniques customarily use a pitch of 0.050 inches. Therefore, when it becomes necessary to interconnect communications equipment with other electronic equipment, there exists the requirement to translate from 0.085 inch pitch contacts to 0.050 inch pitch contacts.

In the early days, there were no adapters for this purpose and connections were performed by soldering mating conductors, one by one. Subsequently, however, connectors were devised to accommodate such a need. One such double-ended connector is disclosed in the U.S. Pat. No. 3,990,797 to Narozny, issued Nov. 9, 1976. The Narozny connector provides mating electrical engagement between differently pitched conductive elements such as flat cable having one spacing between adjacent conductors and a pin or socket connector having a second different spacing between its elements. It utilizes individual contacts for individual mounting in side-by-side relationship within a housing. Each contact is formed with tubular end portions connected by flat central portions. The housing has appropriately positioned and spaced openings in its forward and rearward ends and each individual contact is then bent to the proper shape and inserted into its associated openings. The contacts are of complex shape and require extensive steps in a manufacturing process. Furthermore, the insertion of each contact into its housing is a laborious and time consuming procedure, since the contacts must be positioned one at a time.

There have been other advances concerned with solutions to quickly and accurately place multiple contacts into the housing of a connector. For example, U.S. Pat. No. 3,731,254 to Key, issued May 1, 1973, discloses a dual-in-line connector which incorporates two sets of parallel, spaced, individual terminals fashioned from sheet metal. The terminals extend between a pair of transversely extending carrier strips. When a set of the terminals is positioned upon its associated housing and post portions bent downwardly, the carrier strips are severed from the terminals and removed. Each set enters the housing at an opposite end and extends partially into the housing where they terminate in side-by-side relationship with the other similar set of terminals.

Another such instance is disclosed in U.S. Pat. No. 4,186,988 to Kobler, issued Feb. 5, 1980. The Kobler patent discloses a modular electrical receptacle adapted for mounting on a circuit board. Like the Key patent, Kobler discloses plural spring contact members which initially extend between carrier strips for ease and accuracy of placement in the housing of the connector. When inserted into the receptacle, and the carrier strips removed, the spring contacts have one pitch for engaging a plug which is inserted into the receptacle and another pitch for engaging the circuit board on which the receptacle is mounted.

However, each of these devices exhibits drawbacks related to the manufacturing process in that, in each instance, the contacts must be manually bent or shaped to conform to pre-established configuration. In each instance, this is a laborious and time consuming procedure which undesirably increases the cost of the finished connector.

SUMMARY OF THE INVENTION

It was with knowledge of the prior art as described above that the present invention has been conceived and reduced to practice. It is recognized, of course, that each instance of the prior art mentioned represented a distinct advance in the state of the art when it was initially devised. According to the invention, a preformed electrical insulation displacement connector is disclosed which enables electrical continuity between, for example, telecommunications equipment and other types of electronic equipment. It often occurs, for example, that multiple electrical leads of telecommunications equipment are on a 0.085 inch pitch, that is, centerline distance between connectors, and other types of electronic equipment have multiple electrical leads commonly on a 0.050 inch pitch.

According to the invention, a pair of 25 contact arrays are preformed for rapid and facile assembly as upper and lower rows in an insulative housing. The contacts are mounted at the forward end of the housing so they assume the 0.085 inch pitch and can be engaged by a conventional multiple contact plug. Each contact then extends to a bifurcated tail which is mounted at the aft end of the housing. The plural tails of the contact arrays are adapted to engagingly receive successive leads of conventional flat ribbon cable having a 0.050 inch pitch. Of course, while the values which are presented for pitch are typical as found in everyday practice, the invention is not intended to be so limited but is applicable as an adaptor regardless of the relative pitches.

A particular feature of the invention resides in its ability to accommodate a plural contact capacitor filter array which is adapted to be electrically engaged by the conductor arrays. One or more brackets composed of electrically conductive spring material serve to ground the capacitor filter array while it is positioned within the housing of the connector. In one embodiment of the invention, such a bracket also serves to hold the array fixed in position within the housing. A cover removably mounted on the housing serves to engage the ribbon cable at the aft end of the housing and to hold it firmly in position against the bifurcated tails.

In one embodiment, one carrier strip is integral with the forward ends of the conductors and another carrier strip may be integral with the conductors intermediate therein. These carrier strips serve to hold the individual conductors separated pending their insertion into the housing. At an appropriate point during the assembly operation, the carrier strips are severed or separated from the conductors and the array, as a unit, is then inserted into the housing. Each of the conductors is provided with an appropriate push surface which enables a tool to properly push the conductors into position. When the conductors are fully inserted, the connector is provided with a total of 50 contacts at its forward end, specifically, 25 pairs of vertically spaced contacts. At the aft end of the connector, there are also 50 insulation displacement contacts adapted to engage ribbon cable having 50 parallel conductors. As with the forward contacts, the aft contacts lie in two parallel but spaced rows. However, the contacts are staggered such that a contact of one row lies laterally intermediate a pair of contacts of the opposing row.

The connector of the invention also makes provision for, if desired, a capacitor array with multiple contacts which are engageable with contacts on each of the conductors. The capacitor array is positioned within the housing intermediate the forward and aft contacts of the conductors. A bracket for grounding the capacitor array is also provided as well as a cover to enclose and firmly seat all of the components within the housing.

In an alternative, and preferred embodiment, an electrically insulative carrier member is adapted to mount two contact arrays in generally parallel but separated planes. One array of this embodiment is supported on upper surfaces of the carrier member and the other array is supported on lower surfaces of the carrier member. The carrier member supporting the pair of a contact arrays attached is then inserted into a housing which is adapted to receive the subassembly. In this embodiment, also, provision is made for insertion into the housing of a multiple contact capacitor array which is engaged by the individual contacts and which can be properly grounded. A further spacing element is utilized to hold the bifurcated tails properly spaced before attaching the ribbon cable and applying the cover to seal the unit.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings which are incorporated in and constitute a part of this invention, illustrate some of the embodiments of the invention and, together with the description, serve to explain the principles of the invention in general terms.

DETAILED DESCRIPTION OF THE DRAWINGS

In the drawings:

FIG. 1 is a front perspective view of one embodiment of a fully assembled connector embodying the invention and illustrated as being joined with a multiple contact plug and with multiple conductor ribbon cable;

FIGS. 2, 3, 4, and 5 are, respectively, front elevation, top plan, end elevation and rear elevation views of the main housing for the connector of FIG. 1;

FIGS. 11, 12 and 13 are, respectively, rear elevation, top plan, and end elevation views of a grounding bracket utilized with the invention;

Figure 8:
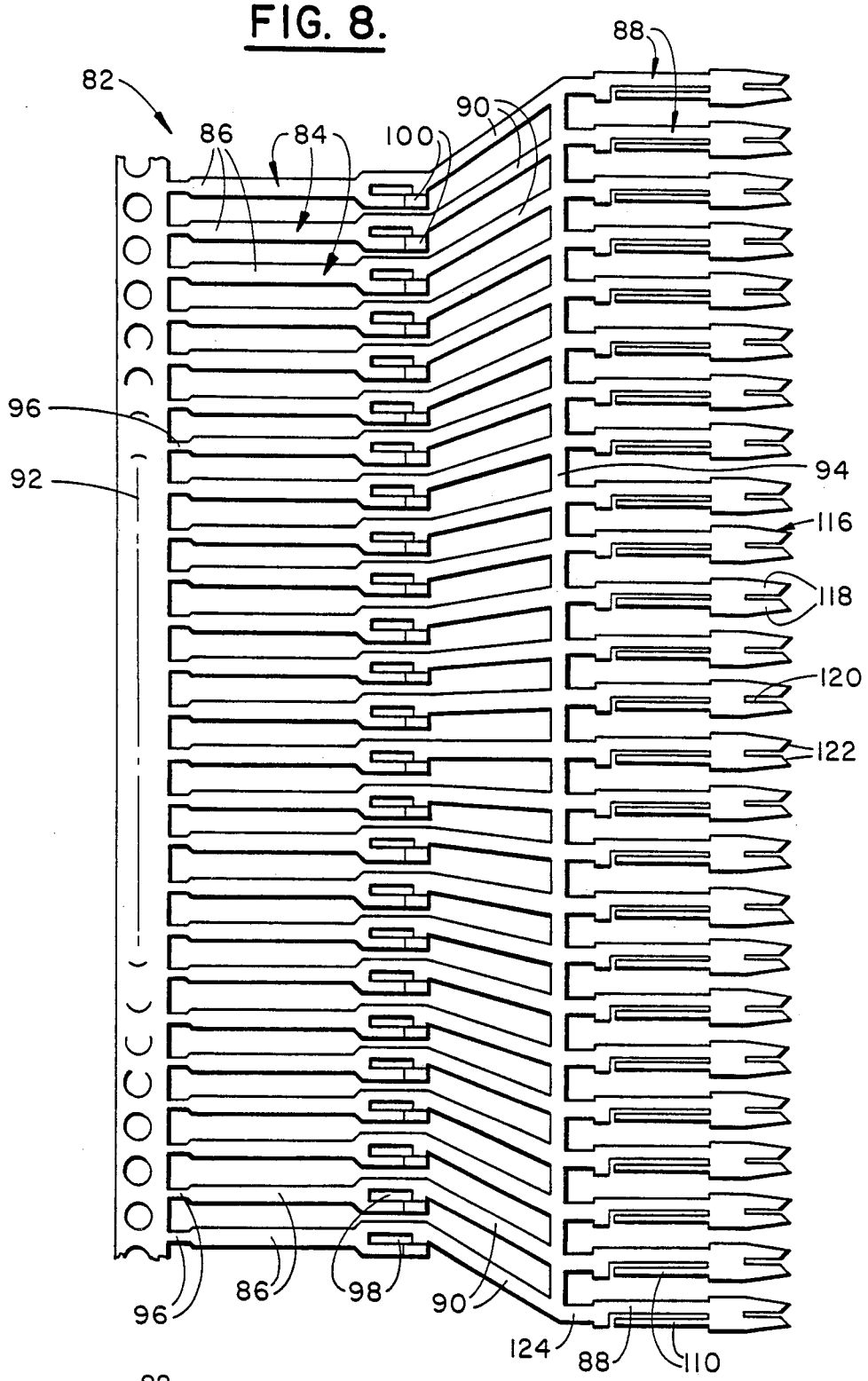
FIG. 8 is a top plan view of a contact array of a type to be utilized with the connector of FIG. 1.
Figure 9:
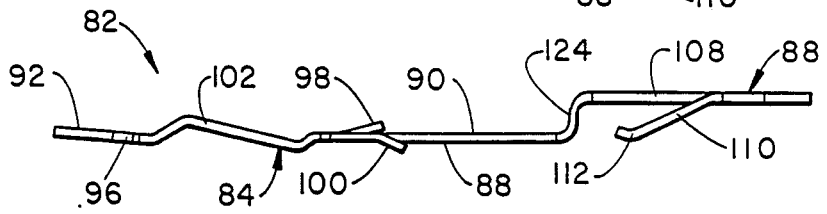
FIG. 9 is a side elevation view of the contact array illustrated in FIG. 8.
Figure 15:
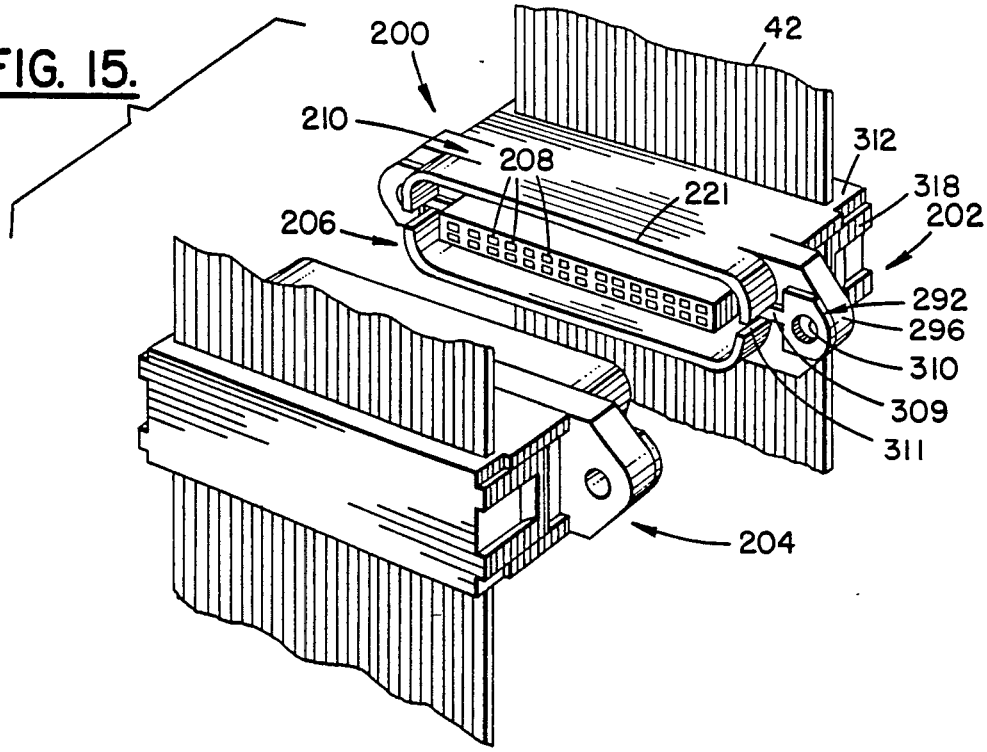
FIG. 15 is a front perspective view, similar to FIG. 1, of another embodiment of the invention.
Figure 29:
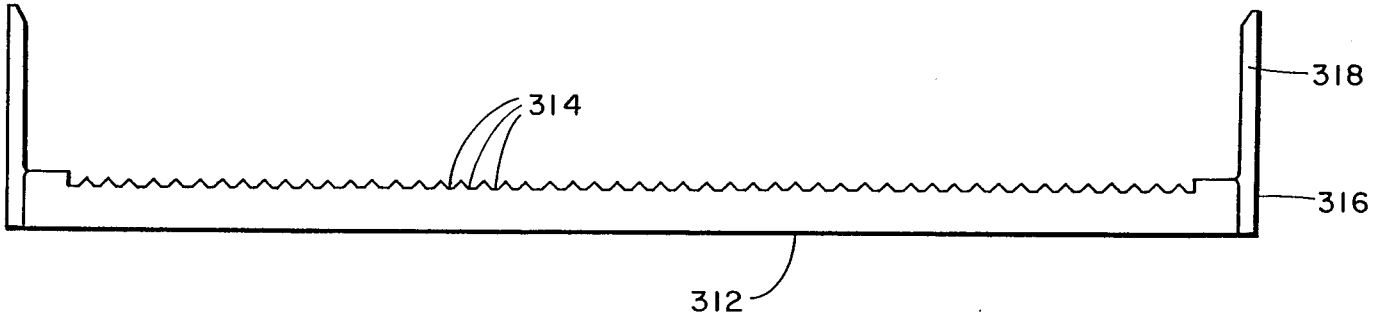
Figure 20:
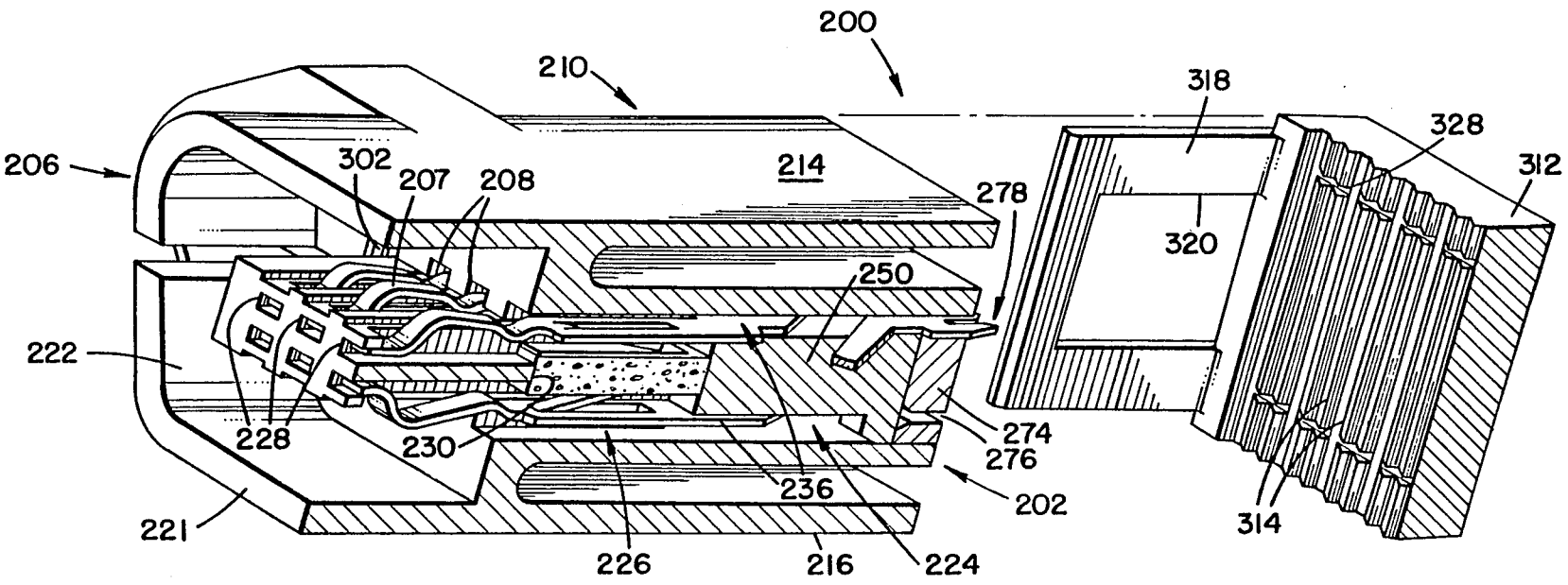
Figure 21:
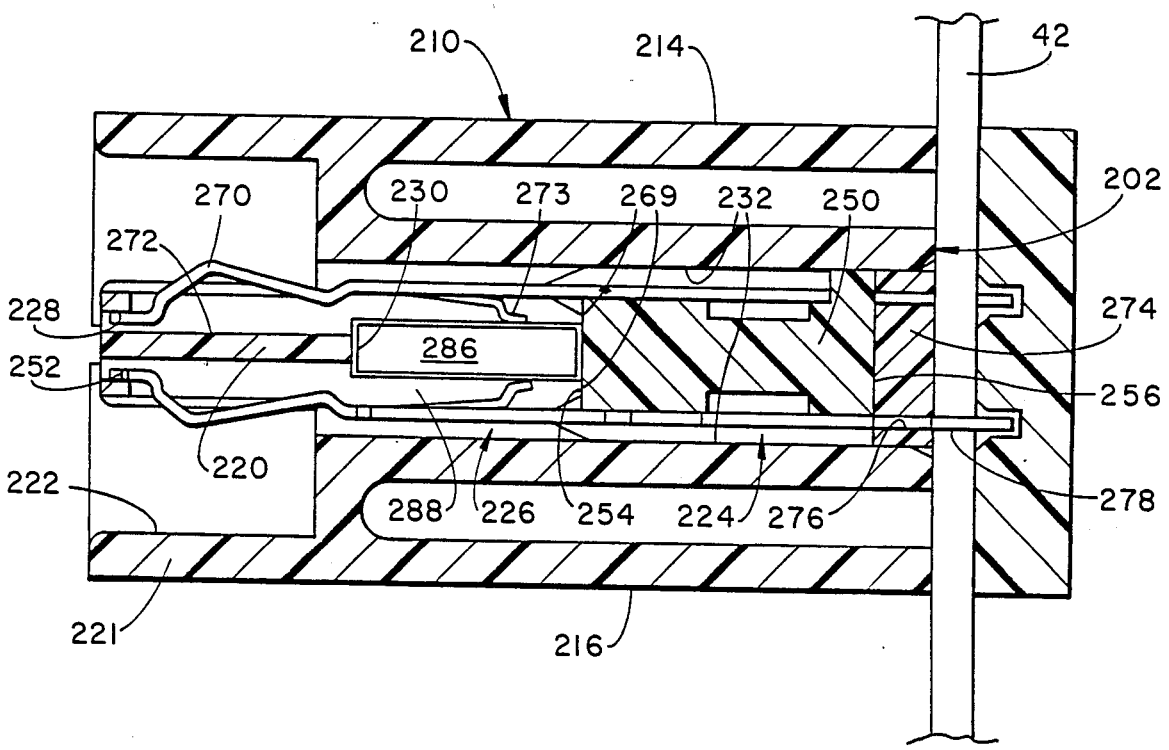
Figure 22:
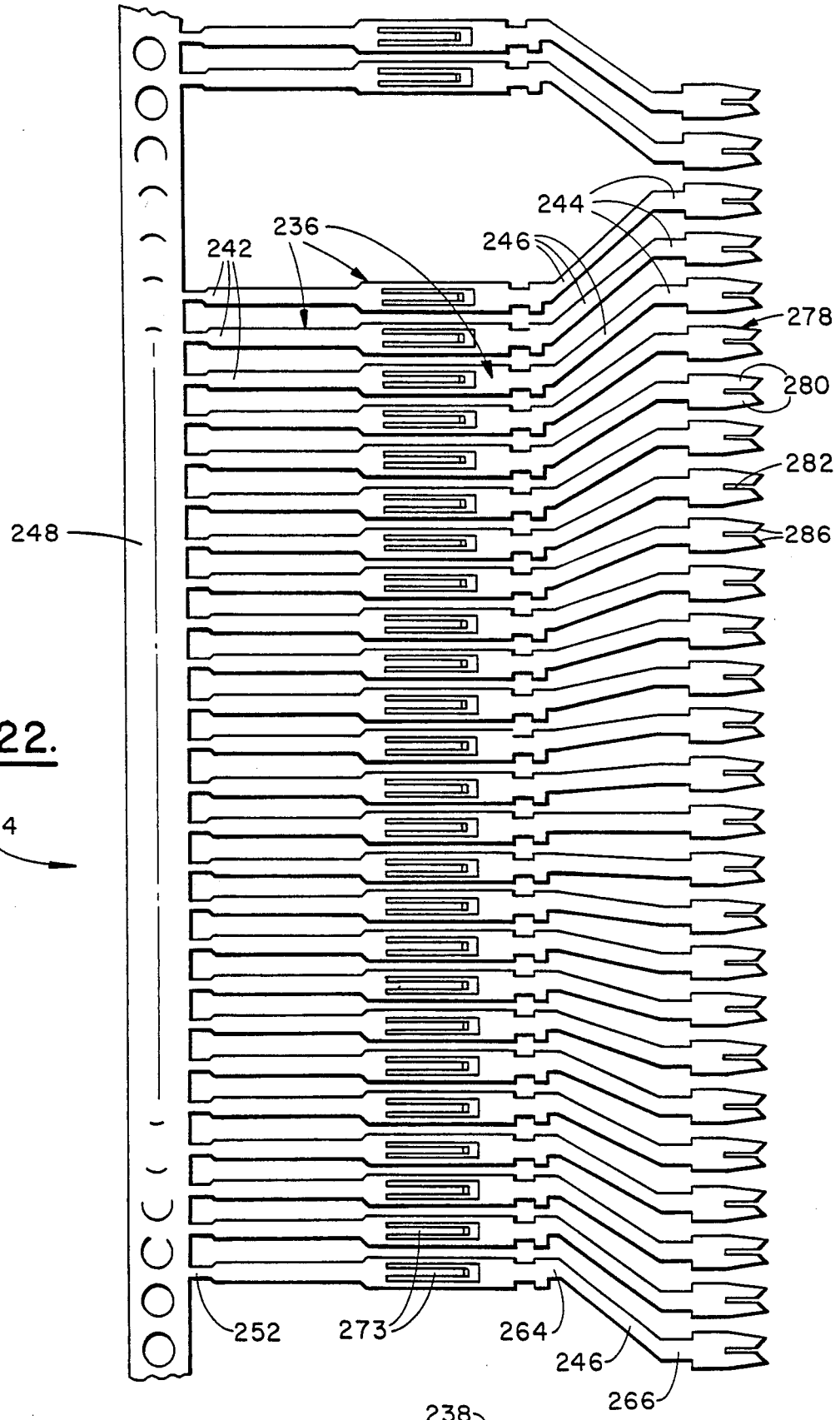
Figure 23:
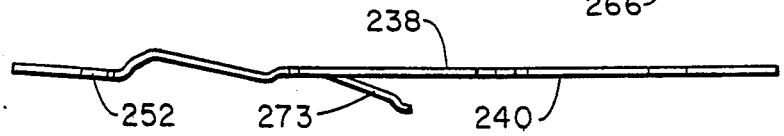
Figure 24:
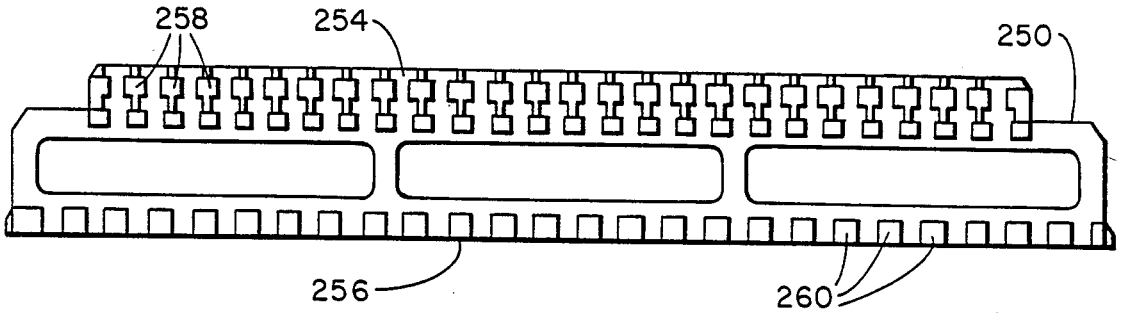
Figure 25:
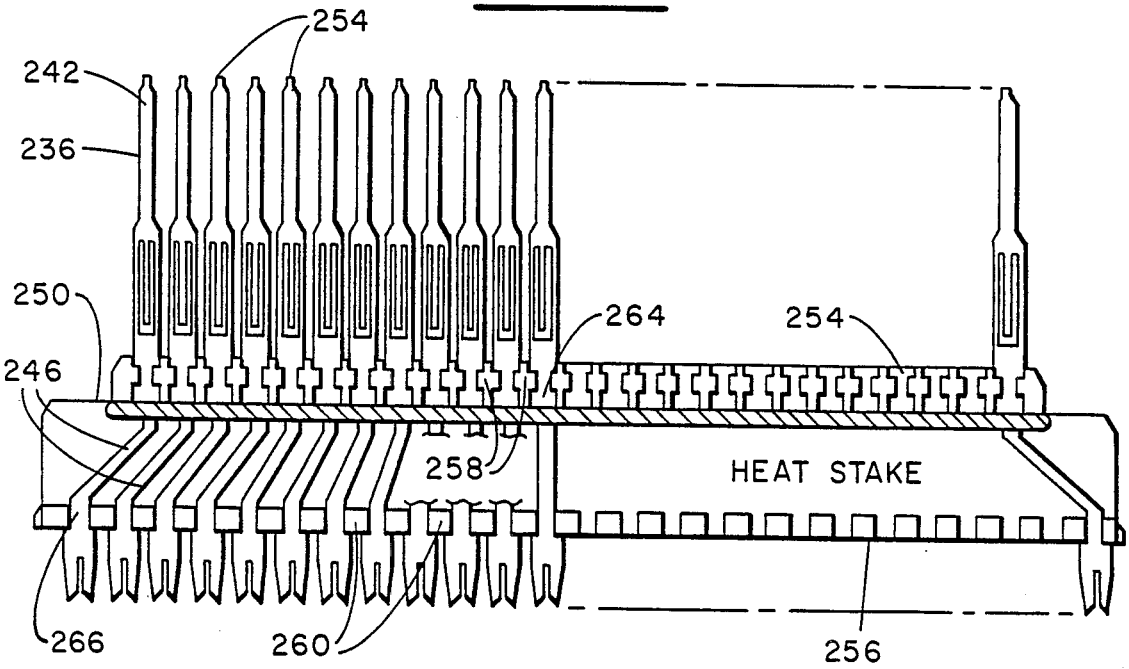
Figure 26:
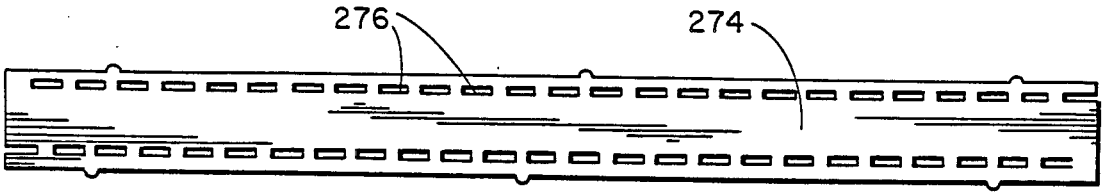
Figure 27:
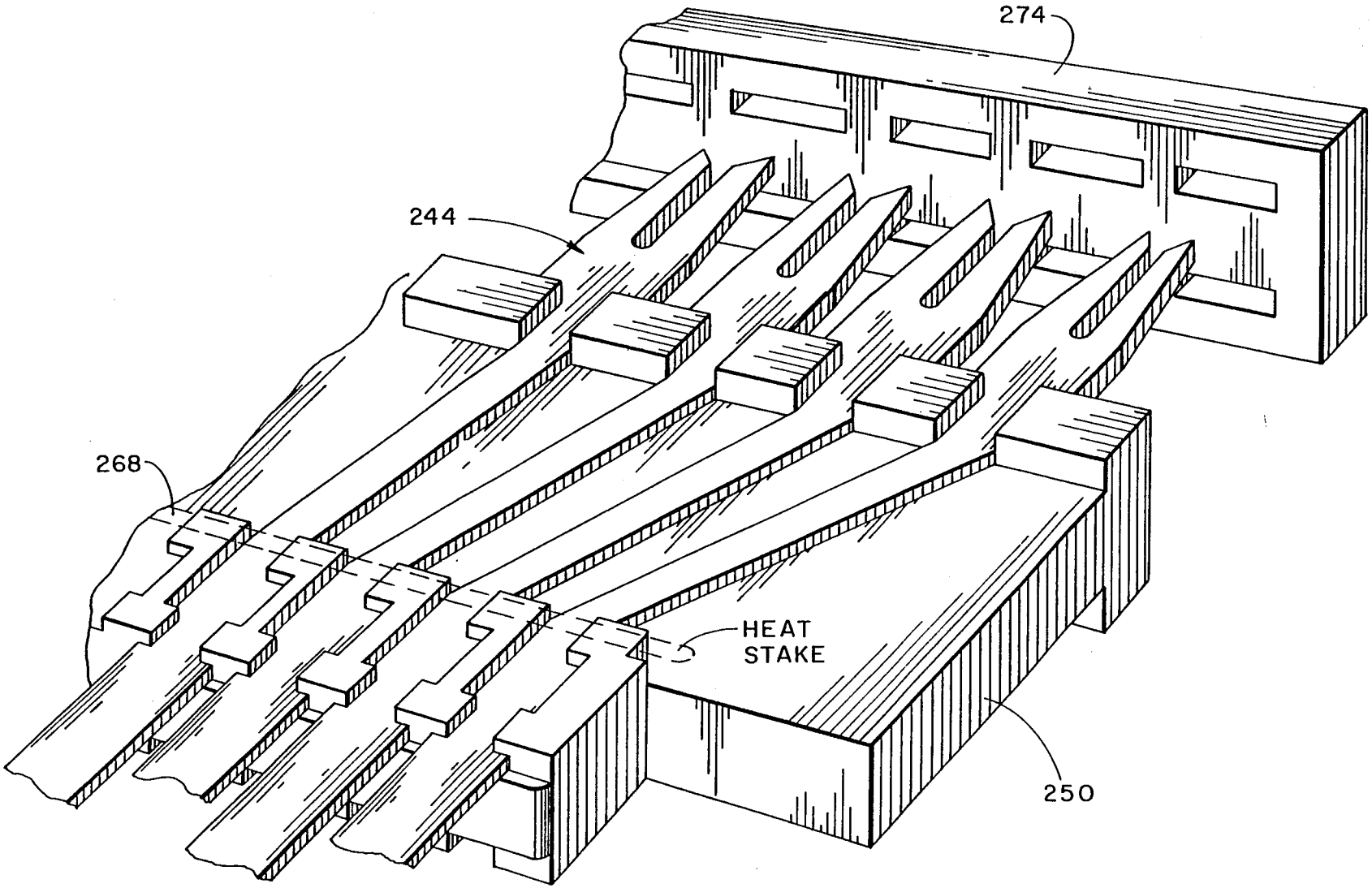
Figure 28:
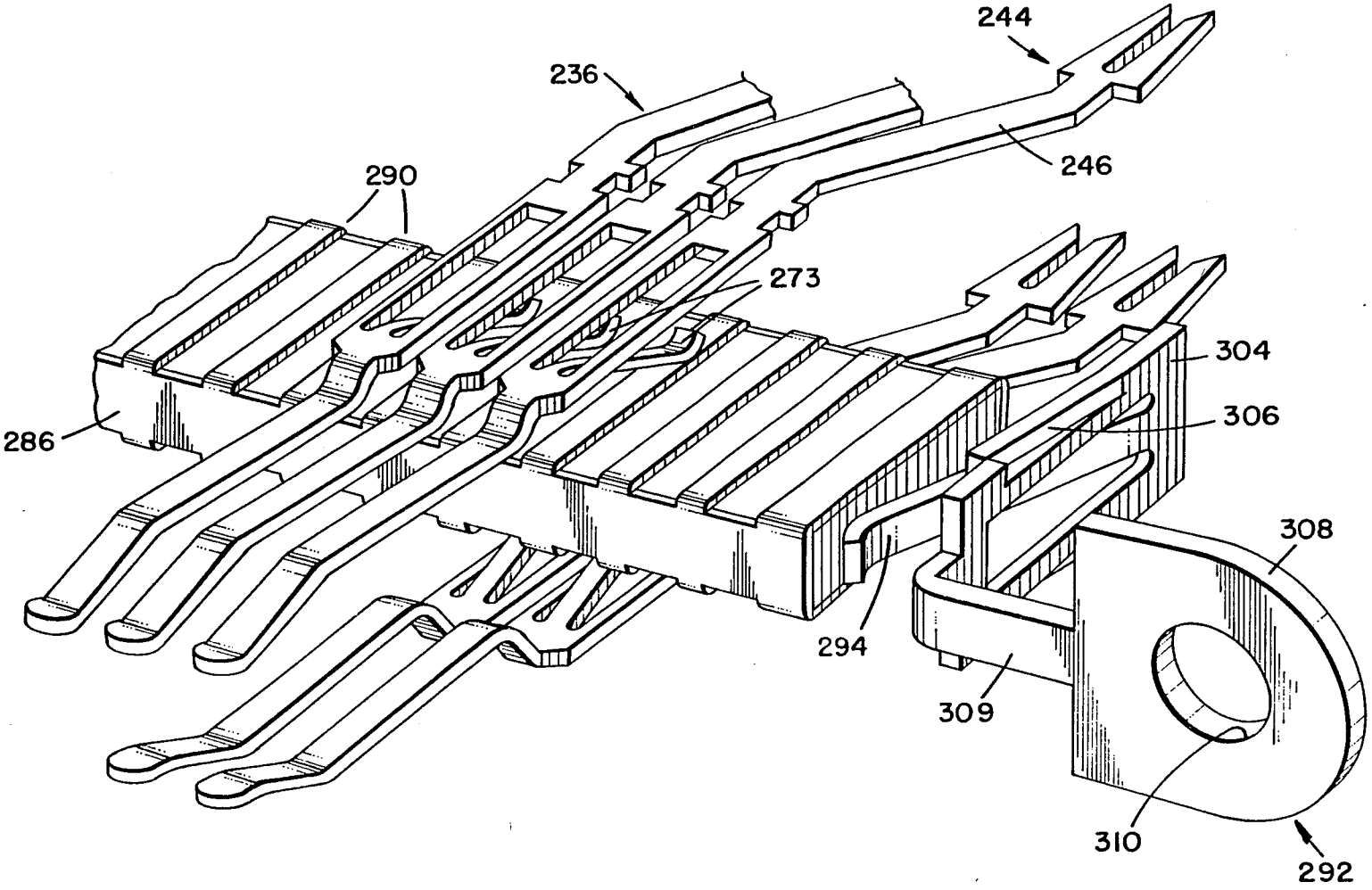

FIGS. 16, 17, 18, and 19 are, respectively, front elevation, top plan, end elevation, and rear elevation views of the housing for the embodiment of the connector illustrated in FIG. 15;

FIG. 20 is an exploded and cutaway view in perspective, similar to FIG. 8, depicting the embodiment of the invention illustrated in FIG. 15;

FIG. 21 is a cross section view similar to FIG. 9 generally illustrating the interior of the connector of FIG. 15;

FIG. 22 is a top plan view of the contact array utilized in conjunction with the connector of FIG. 15;

FIG. 23 is a side elevation view of the contact array illustrated in FIG. 22;

FIG. 24 is a top plan view of an electrically insulative carrier member which is used by the embodiment of FIG. 15;

FIG. 25 is a top plan view of the contact array supported on the insulative carrier member;

FIG. 26 is a rear elevation view of an alignment cover used in conjunction with the combination illustrated in FIG. 25;

FIG. 27 is a detail exploded perspective view illustrating a carrier member supporting a contact array to which an alignment cover is about to be mounted;

FIG. 28 is a detail perspective view illustrating a a pair of contact arrays in combination with an electrical component and a grounding spring, all in the operative position at one end of the connector of FIG. 15; and FIG. 29 is a top plan view of a cover adapted to be joined with the housing to complete assembly of the connector of the FIG. 15 embodiment.

DESCRIPTION OF THE PREFERRED EMBODIMENTS

Figure 2:
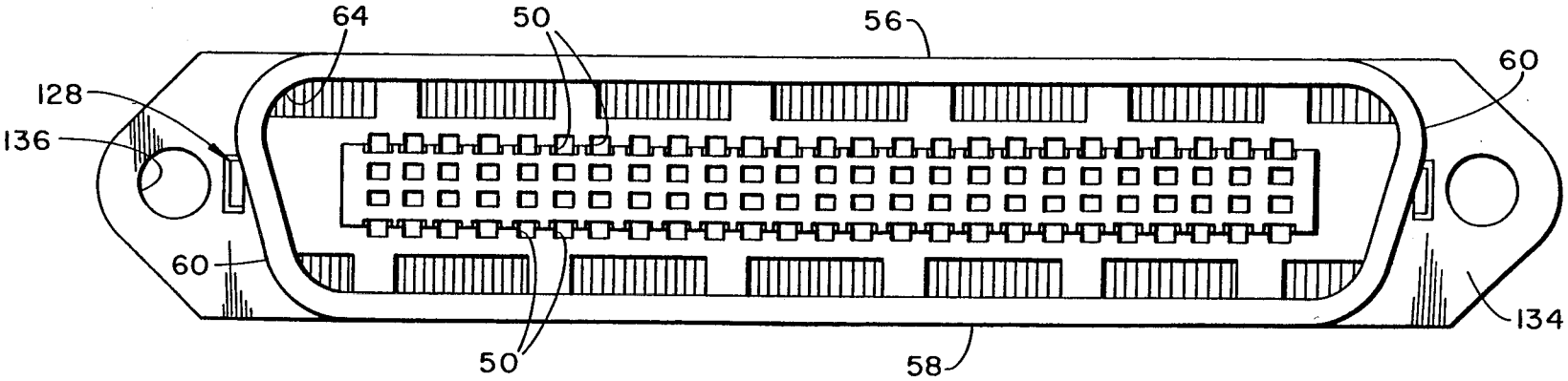
Figure 3:
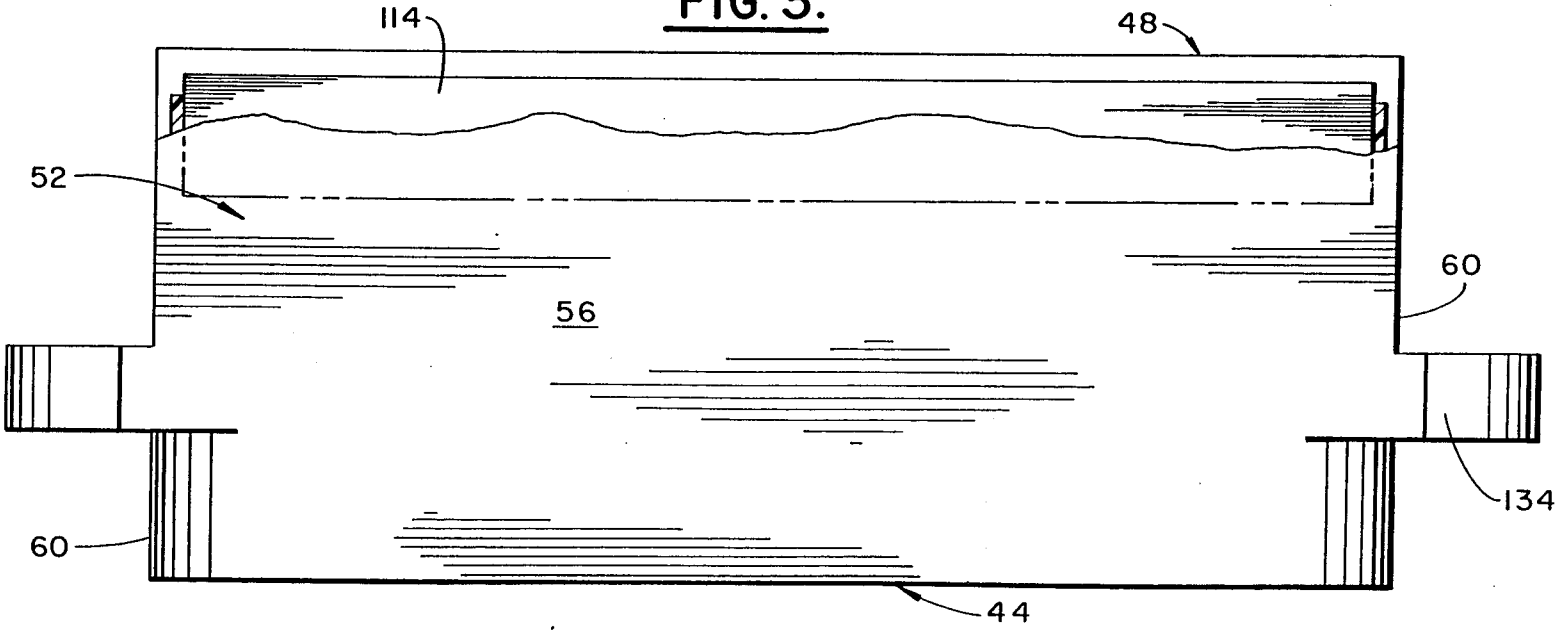
Figure 5:
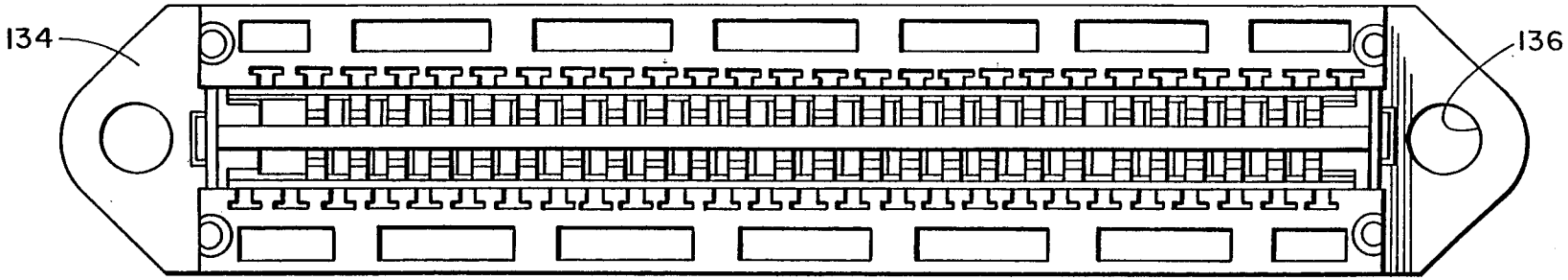

Turn initially to FIG. 1 which illustrates a fully assembled connector 40 representing one embodiment of the invention. The connector 40 is illustrated as being joined with multiple conductor ribbon cable 42 at its aft end 44 and in position to be joined with a mating connector 46 at its forward end 48. A primary feature of the invention resides in its construction according to which a plurality of equally spaced contacts are protectively positioned within the connector at its forward end and as defined by the openings 50. The openings 50, as best seen in FIG. 2, may have, for example, a center line to center line spacing of 0.085 inches. The spacing would be similar to that of the mating contacts in the connector 46 to which the connector 40 is intended to be joined. This represents a first predetermined pitch of the contacts of the connector 40. P In contrast, the connector 40 has a plurality of equally spaced contacts at its aft end 44 which are of a second predetermined pitch different from the first predetermined pitch of a contacts as the forward end. The contacts at the aft end of the connector 40 are preferably of the insulation displacement connector ("IDC") type effective to join with individual leads in the ribbon cable 42. The pitch of the contacts at the aft end of the connector 40 may be, for example, 0.100 inches. However, as will be subsequently described, a further feature of the invention resides in the construction of the connector 40 according to which two levels of contacts are provided such that the spacing of the contacts at the rear of the connector 40 and lying in one plane are offset or staggered with respect to similarly spaced contacts located in another parallel plane. The spacing between adjoining contacts of the two levels of the series of contacts is preferably equal so that the contacts at the aft end 44 of the connector 40 can join with individual conductors of the ribbon cable 42 which customarily have a pitch of 0.050 inches.

Viewing FIGS. 1–7, collectively, the connector 40 comprises an elongated housing 52 composed of any suitable non-conductive material such as glass-filled thermoplastic polyester manufactured by General Electric Company under the tradename "VALOX Type 420-0". The housing 52 includes a top 56, a bottom 58 and sidewalls 60 at either end joining the top and the bottom. As seen especially in FIGS. 6 and 7, the housing 52 also includes a central element 62 extending from the sidewalls 60 generally intermediate the top 56 and bottom 58.

At its forward end 48, the housing 52 defines a forward cavity 64 for engageable reception of the mating multiple contact connector 46. In a similar fashion, housing 52 has an aft cavity 66 at its aft end 44 as well as an intermediate cavity 68 (FIGS. 6 and 7) interconnecting the forward cavity 64 and the aft cavity 66.

For purposes which will be made clear subsequently, the central element 62 includes a forward supporting surface 70 within the forward cavity 64 and an inner supporting surface 72 within the aft cavity 66. A ramp 74 extends from the inner supporting surface 72 into the intermediate cavity 68 sloped toward the top 56 with increasing distance from the aft cavity 66. The central element 62 is also formed with a stop surface 76 which extends generally transversely to a plane of the ramp 74. The ramp terminates at a crest 78 defined by an intersection between the ramp 74 and the stop surface 76. The housing 52 includes an outer supporting surface 80 within the aft cavity 66 and spaced from the inner supporting surface 72. The inner and outer supporting surfaces, 72 and 80 respectively, are generally illustrated as being parallel and that may be a preferred relationship for the assembly of the connector 40 which will be subsequently described.

Another primary element of the connector 40 is a contact array 82 as best illustrated in FIGS. 8 and 9. The contact array 82 is intended for insertion into the housing 52 in a manner to be described below after the basic structure of the array has been described. The contact array 82, as seen in FIG. 8, comprises a plurality of generally equally spaced elongated laterally disposed electrically conductive members 84 of flexible spring material such as Beryllium Copper (Alloy CA172). As illustrated in FIG. 8, there are actually 25 such conductive members 84 in the array 82 each of which has an upper surface 86 and a lower surface 88 (FIG. 9). All of the conductive members 84 include parallel forward members 86 having a first predetermined pitch, that is, distance between successive members. The array of the conductive members 84 also includes a similar number of parallel aft members 88 having a second predetermined pitch different from the first predetermined pitch as just described. Specifically, the lateral distance between adjacent forward members 86 may be, for example, 0.085 inches and that between adjacent aft members 88 may be, for example, 0.100 inches. Each conductive member 84 also includes a transition member 90 which interconnects its associated forward and aft members 86 and 88, respectively.

It is anticipated that each array 82 will be stamped out of sheet material generally having a thickness, for example, of approximately 0.013 inches. The array 82 illustrated in FIG. 8 may be one of a continuing series of arrays joined by a primary carry strip 92. Thus, the form of the array as illustrated in FIG. 8 is such as it may be ejected from the progressive die of a production stamping machine (not shown). The carry strip 92 which is subsequently removed extends transverse of conductive members 84 and is integral with extremities of the forward members 86 and serves to initially support and hold the forward members equally spaced. In a similar fashion, a removable secondary carry strip 94 extends transverse of the conductive members 84 and is integral with each of them intermediate the transition members 90 and the aft members 88. As with the primary carry strip, the secondary carry strip 94 serves to initially support and hold the aft members equally spaced.

In the process of manufacturing the connector 40, the aft members 88 are firmly held by a suitable tool (not shown) and the primary carry strip 92 is severed from each of the conductive members 84 such that the forward members 86 are caused to terminate at a support tab 96 (see FIGS. 6–9). Thereupon, the secondary carry strip 94 is likewise severed from the conductive members. However, in contrast to the primary carry strip 92, the secondary carry strip 94 is severed along lines generally parallel to the conductive members and intermediate each of the conductive members. At this point all of the conductive members 84 are separated from one another while aligned generally in a parallel relationship. The tool holding the aft members 88 is then caused to move forward relative to the housing 52.

Each of the forward members 86 is formed with an aft facing push surface 98 adjacent the transition member 90 and extending out of a general plane of the forward member. Each push surface of the array 82 is engageable by a suitable tool (not shown) or advancing the array into the housing 52 in a direction toward the support pad 56.

As the array of the conductive members 84 is inserted into the aft cavity 66, the support tabs 96 of the several conductive members 84 engage the ramp 74 as they are pushed by a suitable tool engaging the push surfaces 98.

Each forward member 86 is also formed with an aft facing locking tab 100 approximate to the push surface 98 but extending out of the general plane of the transition member in a direction opposite of the push surface. Continued advancement of the array of conductive members 84 into the housing 52 causes the forward members 86 to ride up the ramp 74. When the locking tab 100 reaches the crest 78 of the ramp, it drops down into engagement with the stop surface 76 thereby preventing withdrawal of the conductive members 84 from the housing 52 in a direction away from the support tab 96.

Each of the forward members 86 is formed with an undulation relative to the plane of its transition member 90 to thereby define a nose-shaped first contact member 102 located immediately aft of the support tab 96. As the array continues to advance into housing 52, a tool (not shown) is inserted into the cavity 64 and engages the contact member 102, urging it downwardly (FIG. 7) so that the support tab 96 is caused to engage the forward supporting surface 70. When the conductive member 84 has been fully inserted into the housing 52, the first contact member 102 extends through an opening 104 in a central element 62 and the transition member 90 is caused to rest on the crest 78 of the ramp 74. Thus, with the support tab 96 engaging the forward supporting surface 70, the contact member 102 is biased in a direction transverse of the plane of the transition member and into the forward cavity 64. The contact member 102 is thereby resiliently positioned to engage a contact member of the mating connector 46. While the contact member 102 is biased into the cavity 64, it can move in a direction transverse of a general plane of the conductive member 84 to the extent that the support tab 96 can move between the supporting surface 70 and a shelf 106 integral with the central element 62.

Figure 6:
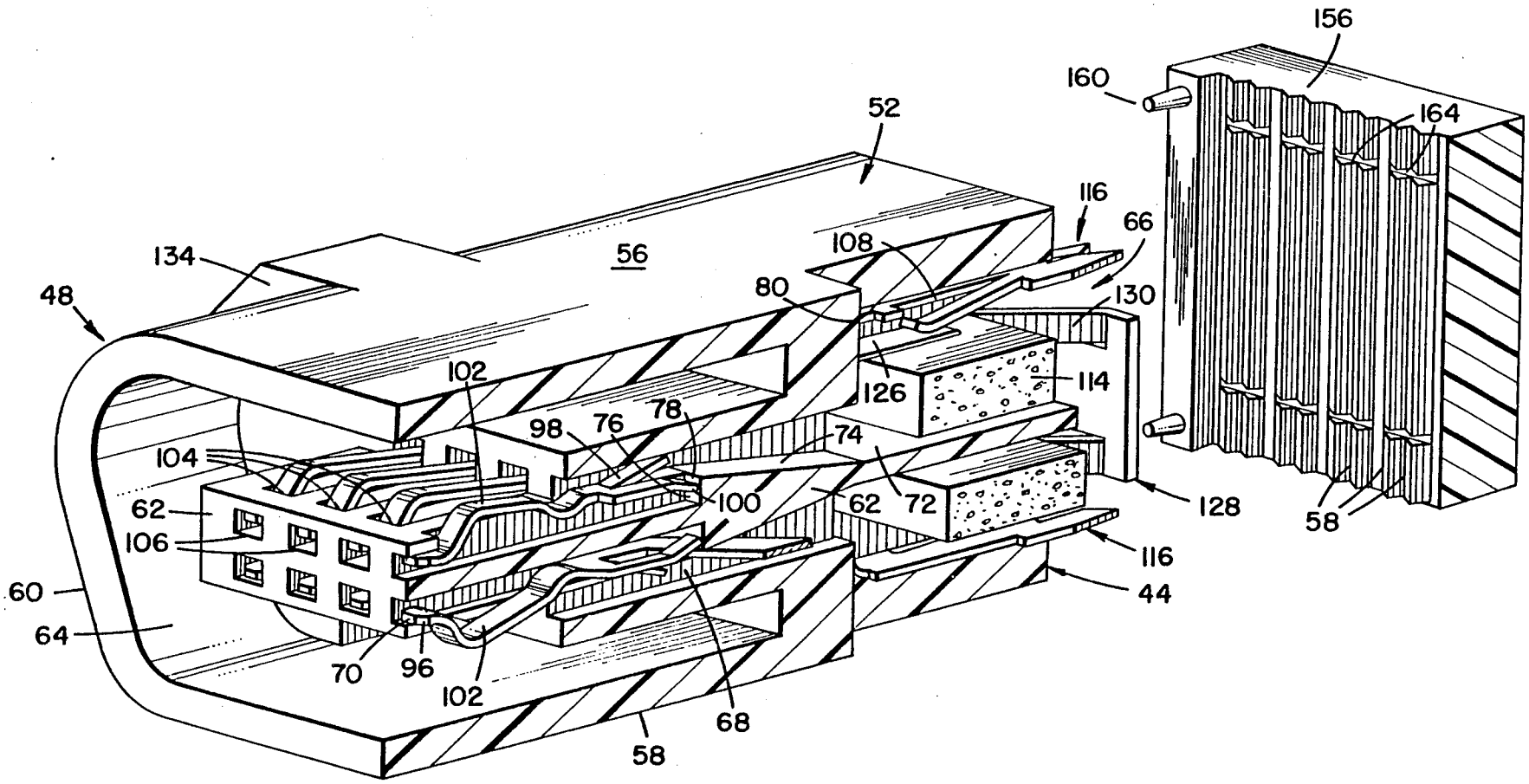
FIG. 6 is an exploded and cutaway perspective view of the connector of FIG. 1 illustrating the housing and contact array as a unit.
Figure 7:
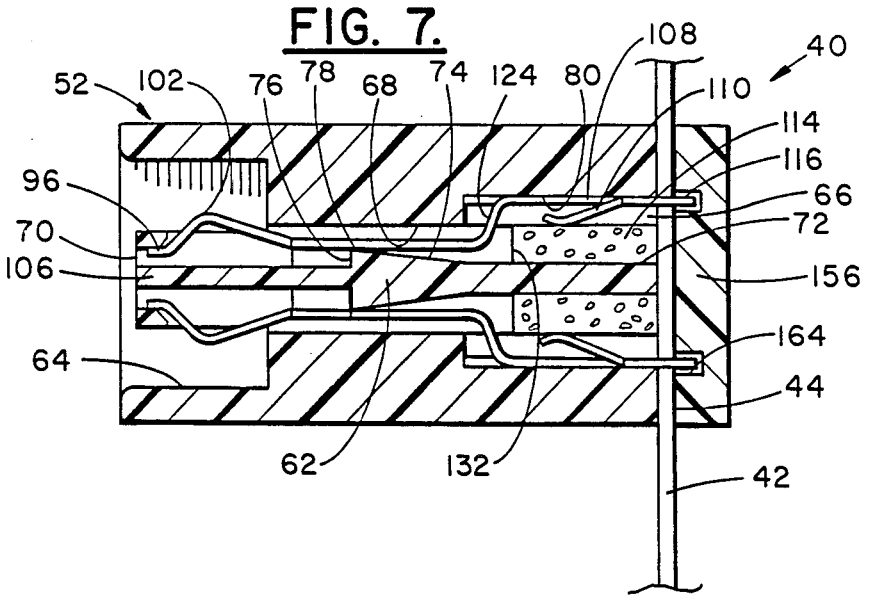
FIG. 7 is a cross-section view generally illustrating the interior of the connector of FIG. 1.

Each of the aft members 88 includes a substantially planar portion 108 which lies in a plane generally parallel to that of its associated transition member 90 and is adapted to engage the outer supporting surface 80 of the housing 52 (see FIGS. 6 and 7). Each of the aft members also includes an active spring member 110 integral with the planar portion 108 and extending out of the plane of the planar portion in a direction away from the outer supporting surface 80. The active spring member 110 has a free end facing the forward member 86 and terminating at a second contact 112 adapted to engage a laterally extending electrical component 114 within the housing.

The planar portion 108 terminates at a bifurcated tail 116 which includes a pair of spaced apart piercing prongs 118 separated by a longitudinally extending conductor receiving slot 120. Each of the prongs 118 is formed with an entry edge 122 adjacent the opening into the slot 120 to guide a transversely extending conductor into the slot when the coductor is moved transversely of its longitudinal axis toward said forward member. Thus, as the ribbon cable 42 is moved transversely toward the connector 40 in the orientation illustrated in FIG. 1, individual conductive elements of the cable 42, each including a conducting wire surrounded by an insulating sheath, are aligned with an associated tail 116.

As the ribbon cable 42 continues to advance toward the connector 40, a conductive element is intercepted by the entry edges 122 and guided into the slot 120. The wire portion of the conductive element is moved transversely of its axis into the slot 120, but the width of the slot is such that the insulation surrounding the wire is penetrated, thereby enabling electrical contact to be established between individual wires of the ribbon cable and individual tails 116. The ribbon cable continues to be moved into the connector 40 until the individual wires thereof reach the innermost ends of the slots 120. As previously described, the transition members 90 and the aft members 88 lie in substantially parallel planes. Furthermore, each of the conductive members 84 includes a jog element 124 lying in a plane transverse to the planes, respectively, of the transition member and the aft member. It is by means of this construction that the connector 40 is able to accommodate the electrical component 114.

The electrical component 114 may be, for example, an a.c. capacitor array which can be utilized to serve as a filter for spurious or undesired signals in electrical transmissions passing through the individual conductive members 84. The component 114, then, is not a necessary element of the connector 40 but may be desired for certain applications. When specific user requirements call for inclusion of the component 114, it is inserted into the aft cavity 66 of the housing 52 and positioned to engageably rest on the inner supporting surface 72 of the central element 62. This occurs after the contact array 82 has already been inserted into the housing 52 and is positioned as illustrated in FIGS. 6 and 7.

Figure 10:
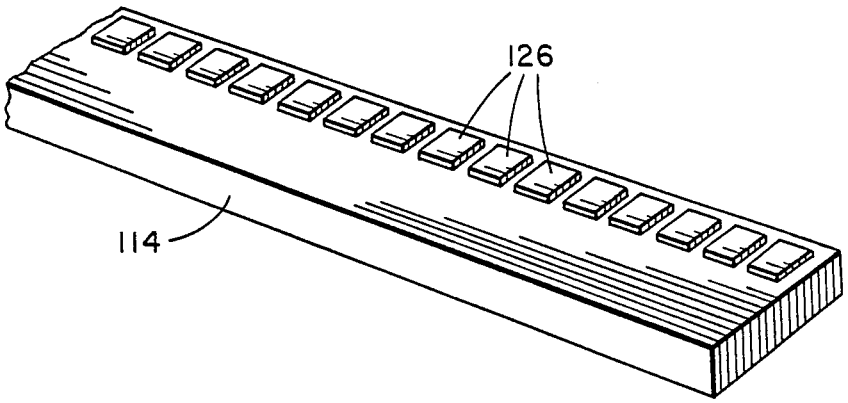
FIG. 10 is a perspective view of a capacitor array utilized with the invention.

As particularly seen in FIG. 10, the component 114 is elongated and provided with a plurality of spaced third contact members 126 at equally spaced locations therealong. When the component 114 is inserted into the cavity 66, each contact member 126 engages an associated active spring member 110 (see FIGS. 6 and 7). The spring bias of the spring members 110 hold them firmly into engagement with the contact members 126 so long as the component 114 remains in position on the surface 72.

Figure 11:
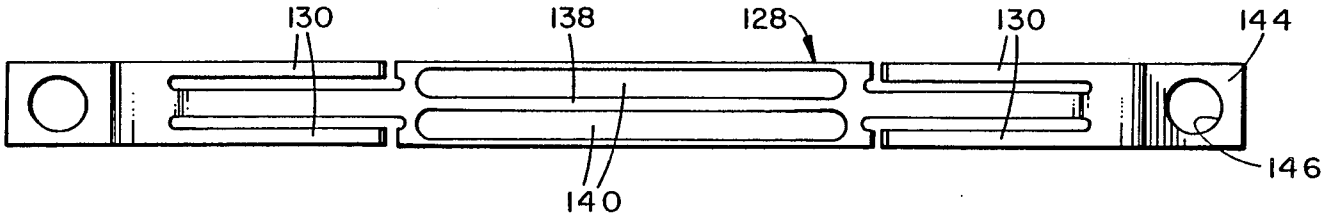
Figure 12:
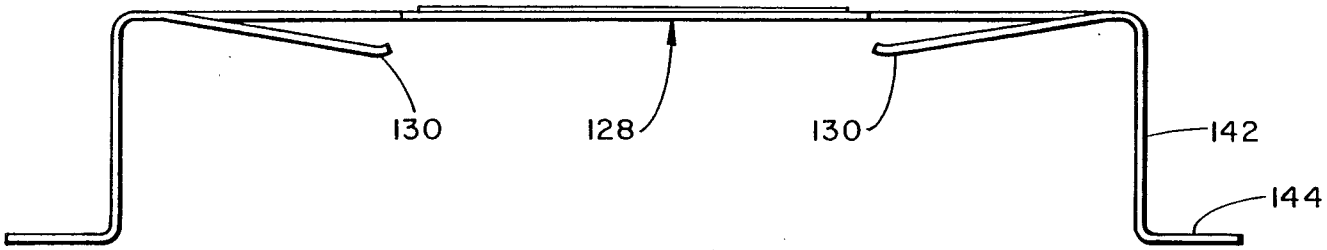

For those end applications in which the connector 40 utilizes an electrical component 114, it is also necessary to include a grounding bracket 128 of suitable electrically conductive material while also having characteristics of a spring. A typical material for the bracket 128 might be alloy CA360 Brass. The bracket 128 is elongated so as to extend across substantially the entire width of the housing 52. As illustrated in FIGS. 11 and 12, the grounding bracket includes four finger contacts 130 spring biased into engagement with the electrical component 114 when it is assembled with the connector 40. Although the bracket 130 is illustrated as having four finger contacts 130, it would be an operable device with a greater or lesser number of such contacts. However, the construction illustrated is preferred since it provides excellent electrical contact and provides for additional support of the component 114 by holding the component fast against a forward surface 132 of the housing 52 within the cavity 66 (see FIG. 7).

The housing 52 includes a pair of mounting ears 134 which extend outwardly from the sidewalls 60. Each of the mounting ears 134 has a first hole 136 extending therethrough adapted to receive a fastener (not shown) for mounting the connector to any suitable manner. The grounding bracket 128 includes a central member 138 which extends along the aft end 44 of the connector. Centrally positioned rib members 140 improve the structural rigidity of the bracket 128. Additionally, the bracket includes, at its ends, a pair of integral, transversely extending, legs 142 and a pair of integral feet 144 extending generally parallel with the central member 138 and contiguous with the mounting ears 134 when the bracket 138 is incorporated into the connector 40. As seen especially in FIG. 11, each of the feet 144 has a second hole 146 therein generally coextensive with the first hole when the bracket 128 is in the operative position. Similarly, the legs 142 are respectively positioned contiguous with the sidewalls 60 of the housing 52.

Viewing FIG. 4, each of the sidewalls 60 has a recessed surface 148 to engageably receive the legs 142. A ramped projection 150 extends outwardly from a central region of the recessed surface 148 and has an outer surface which slopes outwardly from the surface 148 with increasing distance from the aft end toward the forward end 48, then terminates abruptly at a laterally extending ledge 152.

As seen in FIG. 13, each of the legs 42 is formed with an aperture 154 which is adapted to engageably receive an associated projection 150 when the bracket 128 is moved into its operating position. Specifically, the legs 142 are caused to ride up the outer surfaces of the projections 150 as the bracket is being mounted on the bracket until, with further movement of the bracket toward engagement with the housing, the ledge 152 is caused to enter the aperture 154. Being of spring material, the legs 142 are biased into contiguous relationship with the surface 148 and the feet 144 into contiguous relationship with the mounting ears 134. Furthermore, by reason of the ledge 152, inadverent withdrawal of the grounding bracket from the connector 40 is prevented.

Figure 14:
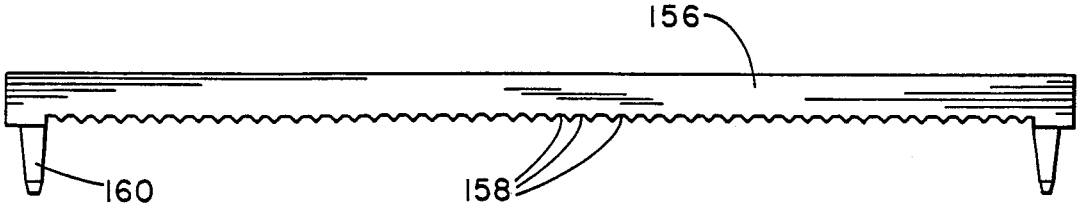
FIG. 14 is a top plan view of a connector cover utilized with the connector of the invention.

Thereupon, in the process of assembling the connector 40, the ribbon cable is joined with the tails 116 of the conductive members 84 in the manner previously described. Finally, a cover 156 is mounted to the aft end 44 of the housing 52, preferably in a releasable fashion. When the cover 156 is mounted in position as illustrated in FIG. 1, it is generally coextensive with the aft end 44 and is engageable with the ribbon cable 42 to prevent movement of the ribbon cable relative to the housing. As seen especially in FIGS. 6 and 14, the cover includes a plurality of transversely extending parallel slots 158 appropriately spaced so that each of the slots can engageably receive one of the conductors of the ribbon cable 42 when the cover is mounted on the aft end 44.

For joining the cover 156 to the housing 52, one suitable design provides a plurality of outwardly extending tapered pins 160 integral with the cover and extending outwardly therefrom frictionally engageable with mating tapered bores 162 formed in the aft end 44 of the housing 52. Thus, when the cover 146 is moved toward the housing 52 such that the pins 160 engage with their associated bores 162, continued force imposed on the cover 156 causes the pins to become frictionally engaged with the bores and serve to firmly hold the cover in position. However, desirably, with some effort, the cover 156 can be removed from the housing 52 whenever its removal is desired.

As seen in FIGS. 6 and 7, the tails 116 extend beyond the aft end 44 in order to provide proper engagement with the conductors of the ribbon cable 42. Therefore, to accommodate the tails 116, the cover is formed with laterally extending depressions 164 to loosely receive the tails therein when the cover 156 is mounted on the aft end 44.

As best seen in FIGS. 6 and 7, the housing 52 includes identical but mirror imaged upper and lower levels with the central element 62 being common to each of the levels. The conductive members 84 are positioned in an upper level and in a lower level, a full array 82 being positioned at each level. However, it will be appreciated that while the first contact members 102 of the upper level are laterally aligned with those of the lower level (see FIG. 2), the tails 116 of the upper level are laterally offset relative to the tails of the second level (see FIG. 5) such that the tails of one level are equidistant from adjacent ones of the tails of the second level. In this fashion, then, every second conductor of the ribbon cable will engage with every second tail 116 of an array at a given level within the housing 52. Similarly, every other conductor of the ribbon cable will engage with every other tail 116 of the array at another level, but successive conductors of the ribbon cable will engage, in turn, tail 116 at one level then the next adjacent tail 116 at the other level. In this manner, while the spacing between tails of a single array 82 may be, for example, 0.100 inches, the lateral distance between successive tails of the two sets of arrays may be, for example, only 0.050 inches, or equivalent to the pitch of the ribbon cable 42.

Figure 16:
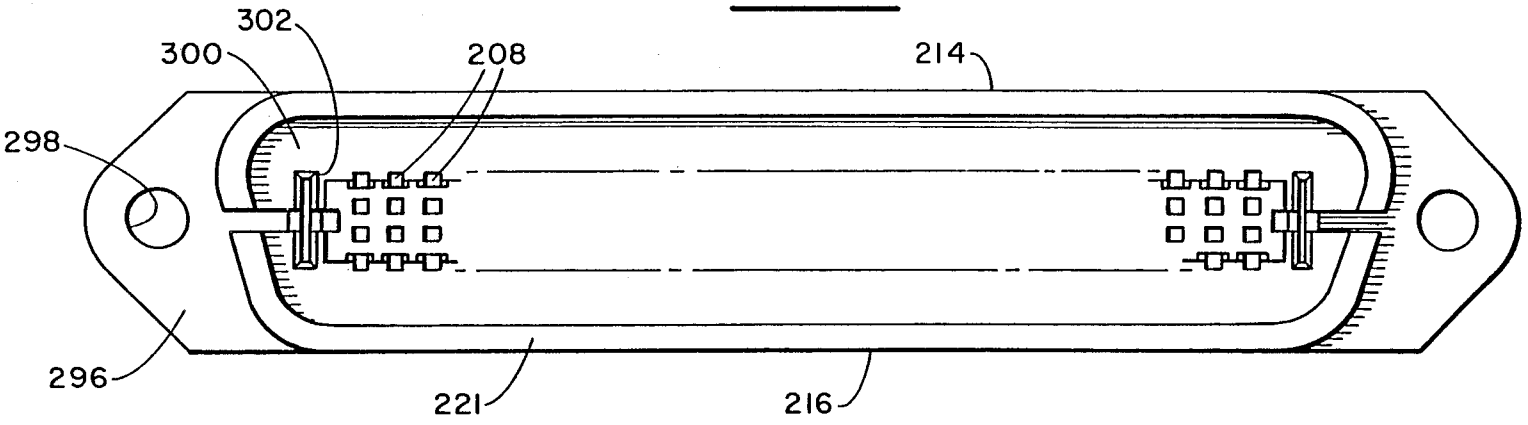

Another, and preferred, embodiment of the invention is illustrated in FIG. 15 wherein a connector 200 is shown joined with multiple conductor ribbon cable 42 at its aft end 202 and in position to be joined with a mating connector 204 at its forward end 206. As with the preceding embodiment, a primary feature of the connector 200 resides in its construction according to which a plurality of equally spaced contacts are protectively positioned within the connector at its forward end and as defined by a plurality of equally spaced openings 208. The openings 208, as best seen in FIG. 16, may have, for example, a center line to center line spacing of 0.085 inches. The spacing would be similar to that of mating contacts in the connector 204 to which the connector 200 is intended to be joined. This represents a first predetermined pitch of the contacts of the connector 200.

In contrast, the connector 200 has a plurality of equally spaced contacts at its aft end 202 which are of a second predetermined pitch different from the first predetermined pitch of the contacts at the forward end. As with the preceding embodiment, the contacts at the aft end of the connector 200 are preferably of the insulation displacement connector ("IDC") type effective to join with individual leads in the ribbon cable 42. The pitch of the contacts at the aft end of the connector 200 may be, for example, 0.100 inches. However, as will be subsequently described, a further feature of the connector 200 resides in its construction according to which two levels of contacts at the rear thereof and lying in one plane are offset or staggered with respect to similarly spaced contacts located in another parallel plane. The spacing between adjoining contacts of the two levels of the series of contacts is preferably equal so that the contacts at the aft end 202 of the connector 200 can join with individual conductors of the ribbon cable 42 which customarily have a pitch of 0.050 inches.

Viewing FIGS. 15–19, collectively, the connector 200 comprises an elongated housing 210 which may be composed of the same non-conductive material as the housing 52. The housing 210 includes a top 214, a bottom 216 and sidewalls 218 at either end joining the top and the bottom. As seen especially in FIGS. 20 and 21, the housing 210 also includes a central element 220 extending from the sidewalls 218 generally intermediate the top 214 and bottom 216.

At its forward end 206, a continuous forwardly extending flange 221 defines a forward cavity 222 for engageably receiving the mating multiple contact connector 204. In a similar fashion, the housing 210 as an aft cavity 224 at its aft end 202 as well as an intermediate cavity 226 (FIGS. 20 and 21) interconnecting the forward cavity 222 and the aft cavity 224.

As with the earlier embodiment, the central element 220 includes a forward supporting surface 228 within the forward cavity 222. However, different from the earlier embodiment, the central element terminates at a stop surface 230 adjacent the intermediate cavity 226 and extending generally transversely of a plane of the central element. Also, the housing 210 includes a pair of spaced apart aft supporting surfaces 232 within the aft cavity 66. The supporting surfaces 232 are generally illustrated as being parallel and that may be a preferred relationship for the assembly of the connector 200 which will be subsequently described.

Another primary element of the connector 200 is a contact array 234 as best illustrated in FIGS. 22 and 23. The contact array 234 is intended for insertion into the housing 210 in a manner to be described below after its basic structure is understood. Similar to the array 82 previously described, the contact array 234, as seen in FIG. 22, comprises a plurality of generally equally spaced elongated laterally disposed electrically conductive members 236 of flexible spring material such as Beryllium Copper (Alloy CA172). As illustrated in FIG. 22, there are actually 25 such conductive members 236 each of which has an upper surface 238 and a lower surface 240 (FIG. 23). All of the conductive members 236 include parallel forward members 242 having a first predetermined pitch, that is, distance between successive members. Each of the conductive members 236 also includes a similar number of parallel aft members 244 having a second predetermined pitch different from the first predetermined pitch as just described. Specifically, the lateral distance between adjacent forward members 242 may be, for example, 0.085 inches and that between adjacent aft members 244 may be, for example, 0.100 inches. Each conductive member 236 also includes a transition member 246 which interconnects its associated forward and aft members 242 and 244, respectively.

It is anticipated that each array 234 will be stamped out of sheet material generally having a thickness of approximately 0.013 inches. The array 234 illustrated in FIG. 22 may be one of continuing series of arrays joined by a primary carry strip 248. Thus, the form of the array as illustrated in FIG. 22 is such as it is ejected from the progressive die of a production press (not shown). At the top of FIG. 22 is illustrated a part of an adjacent contact array identical to the main array shown and attached to the carry strip 248. The carry strip 248 which is subsequently removed extends transverse of the conductive members 236 and is integral with extremeties of the forward members 86 and serves to initially support and hold the forward members equally spaced.

In the process of manufacturing the connector 200, the contact array 234 is mounted on an electrically insulative carrier member 250 (FIG. 24) in the manner illustrated in FIG. 25 and the primary carry strip 248 is severed from each of the conductive members 236 such that the forward members 242 are caused to terminate at a support tab 252 (FIGS. 22, 23, and 25). At this point all of the conductive members 84 are separated from one another while aligned generally in a parallel relationship as they are supported on the carrier member 250. The tool holding the aft members 244 is then caused to move forward relative to the housing 210.

The carrier member 250, as seen in FIGS. 24 and 25, is composed of a non-conductive material, desirably similar to that used for the housing 210. The carrier member 250 is elongated and has substantially the width of the aft cavity 224. As seen in FIG. 24, it has a forward portion 254 and an aft portion 256. At equally spaced intervals along the forward portion 254, the carrier member 250 is provided with a plurality of upstanding projections 258 and similar upstanding projections 260 are provided at equally spaced intervals along the aft portion 256. The spacing between adjacent projections 258 is the same as that between the projections 260.

When the array 234 is supportively mounted on the carrier member 250 as illustrated in FIG. 25, a first support region 264 of each conductive member 236 is received between the projections 258 to rest on an upper surface of the carrier member 250. Similarly, a second support region 266 of the conductive member 236 spaced from the support region 264 in a direction away from the support tabs 252 is received between adjacent projections 260 and supported on an upper surface of the carrier member 250. It will be appreciated that the relative positioning of the projections 258 and 260 is such as to accommodate the offset of the successive conductive members 236 caused by the transition members 246. Also, by supporting the conductive members 236 at spaced locations as defined by the support regions 264 and 266, the conductive members 236 are held against movement relative to one another not only in a lateral direction, but also longitudinally and, even more importantly, rotationally about a vertical axis. Once the array of conductive members 236 has been positioned on the carrier member 250 as illustrated in FIG. 25, it is desirable to heat stake the conductive members 236 to the carrier number 250 adjacent the projections 258 at a region denoted by a reference numeral 268. A contact array 234 is thus mounted on one side of the carrier member 250 and, in a similar fashion, another contact array 234 is mounted to the opposite side of the same carrier member.

The carrier member 250 and its pair of contact arrays 236 mounted thereon are then caused to move forward relative to the housing 210 such that the support tabs 252 enter the aft cavity 224. Each of the forward members 242 is formed with an undulation relative to the plane of its transition member 246 to thereby define a nose-shaped first contact member 270 located immediately aft of the support tab 252 (see FIGS. 22 and 23). As the arrays 234, with their carrier 250, continue to advance into the housing 210, a tool (not shown) is inserted into the cavity 222 and engages the contact members 270 to move them toward a central horizontal plane of the connector 200 (see FIGS. 20 and 21) so that their associated support tabs 252 are caused to engage the forward supporting surfaces 228. When the assembly comprising the carrier member 250 and its pair of contact arrays 234 thereon has been fully inserted into the housing 210, outermost surfaces of the carrier member fittingly engage the walls of the aft cavity 224. When the tool engaging the contact members 270 has been withdrawn from the cavity 222 such that the support tabs 252 engage their associated forward supporting surfaces 228, the contact members 270 are thereby biased in a direction transverse of the plane of the conductive member 236 and into the forward cavity 222.

The contact members 270 are thereby resiliently positioned to engage the contact members of the mating connector 204. While each contact member 270 is biased into the cavity 222, it can move in a direction transverse of a general plane of the conductive member 236 to the extent that the support tab 252 can move between the supporting surface 228 and a shelf surface 272 on the central element 220. A second contact member 273 is also formed in the forward member 242 at a wider region thereof and extends out of the general plane of the conductive member 236 for a purpose to be described below.

Viewing especially FIG. 21, it is seen that when the carrier 250 is inserted into the cavity 224 such that the support tabs 252 engage their associated supporting surfaces 228, the aft members 244 extend beyond the aft end 202 of the housing 210. An alignment cover 274 (FIGS. 26 and 27) is then slipped over aft members 244 and moved into abutting engagement with the aft portion 256 of the carrier member 250. The alignment cover 274 is provided with two rows of spaced apart slotted openings 276 to loosely receive the aft members 244 therethrough. As illustrated most clearly in FIGS. 20 and 21, the forwardmost portions of the openings 256 may be tapered so as to readily receive therein the aft members. When the alignment cover 274 is butted against the carrier 250, all of the remaining space within the cavity 224 thereby becomes occupied. The alignment cover 274 serves to hold the aft members 244 in an equidistant relationship and provides them with additional structural rigidity after the arrays have been mounted on the carrier 250. It will be appreciated that although the alignment cover 274 has been described as being applied after the carrier 250 and its supported contact arrays 234 have been inserted into the body of the housing 210, it could just as easily have been applied in a step prior thereto.

As previously described, each of the aft members 244 includes a substantially planar support region 266 which is adapted to engage an outer supporting surface of the carrier member 250 (see FIGS. 25 and 27). The support region 266 terminates at a bifurcated tail 278 which includes a pair of spaced apart piercing prongs 280 separated by a longitudinally extending conductor receiving slot 282. Each of the prongs 280 is formed with an entry edge 284 adjacent the opening into the slot 282 to guide a transversely extending conductor into the slot when the conductor is moved transversely of its longitudinal axis toward said forward member. Thus, as the ribbon cable 42 is moved transversely toward the connector 200 in the orientation illustrated in FIG. 15, individual conductive elements of the cable 42, each including a conducting wire surrounded by an insulating sheath, are aligned with an associated tail 278. As the ribbon cable 42 continues to advance toward the connector 200, a conductive element is intercepted by the entry edges 284 and guided into the slot 282. The wire portion of the conductive element is moved transversely of its axis into the slot 282, but the width of the slot is such that the insulation surrounding the wire is penetrated, thereby enabling electrical contact to be established between individual wires of the ribbon cable and individual tails 278. The ribbon cable continues to be moved into the connector 200 until the individual wires thereof reach the innermost end of the slots 282.

The construction of the connector 200 is such that it is able to accommodate an electrical component 286. The electrical component 286 may be, for example, an a.c. capacitor array which can be utilized to serve as a filter of spurious or undesired signals in electrical transmissions passing through the individual conductive members 236. The component 286, then, is not a necessary element of the connector 200 but may be desired for certain applications. When specific user requirements call for inclusion of the component 286, it is inserted to the aft cavity 224 of the housing 210 until it abuts against the stop surface 230 (FIG. 20). A plurality of parallel spaced ribs 288 (FIG. 21) within the intermediate cavity 226 extend in a fore and aft direction and transversely relative to the top 214 and bottom 216. Each of the ribs has terminal edges which collectively define a slot for loosely receiving and supporting the electrical component 286. It is also noteworthy that the ribs 288 have rearmost edges 289 against which the forward portion 254 of the carrier member abuts when the carrrier member assumes its operative position.

As particularly seen in FIG. 28, the component 286 is elongated and provided with a plurality of spaced third contact members 290 at equally spaced locations therealong. When the component 286 is inserted into the cavity 226, each contact member 290 engages an associated active spring or second contact member 273 (see FIG. 28). The spring bias of the contact members 273 holds them firmly into engagement with the contact members 290 so long as the component 286 remains in position on the ribs 288.

One major benefit of the embodiment of FIG. 15 as contrasted with that of FIG. 1 is that the former only requires one capacitor array to accommodate the fifty contact positions while the latter requires two separate capacitor arrays.

For those end applications in which the connector 200 utilizes an electrical component 286, it is also necessary to include at least one grounding bracket 292 of suitable electrically conductive material.

According to the preferred embodiment of the connector 200, however, a pair of laterally spaced grounding brackets 292 are employed at either end of the component 286. The relationship between a mounted grounding bracket 292 and the electrical component 286 at one end of the connector 200 is illustrated in FIG. 28. As shown in that figure, the grounding bracket 292 includes a fourth contact member 294 biased into engagement with an end of the electrical component 286.

The housing 210 includes a pair of mounting ears 296 which extend outwardly from the sidewalls 218. Each of the mounting ears 296 has a first hole 298 extending therethrough adapted to receive a fastener (not shown) for mounting the connector in any suitable manner. The housing 210 also has a forward face 300 and a pair of laterally spaced slots 302 (see FIG. 16) open at the face 300 and extending rearwardly thereof and communicating with the intermediate cavity 226. A leg member 304 (see FIG. 28) of the grounding bracket 292 is loosely received in each of the slots 302 and includes spring biased finger elements 306 which are suitably engageable with an appropriate stop surface of the housing to prevent removal thereof when the bracket is fully inserted into the slot. As previously described, when this occurs, the fourth contact members 294 are sufficiently biased to engage the ends of the electrical component 286. The grounding bracket 292 also includes an integral foot 308 extending, via a connecting strip 309, transversely of the leg member 304 and contiguous with an associated mounting ear 296 when the bracket is fully inserted into the slot 302. Each foot 308 has a second hole 310 therein which is coextensive with the first hole 298 when the grounding bracket 292 is in its operative position. Further, in order for the bracket 292 to assume its operative position, the connecting strip 309 extends through a discontinuity 311 in the flange 221.

Thereupon, in the process of assembling the connector 200, the ribbon cable 42 is joined with the tails 278 of the conductive members 236. Finally, a cover 312 is mounted to the aft end 202 of the housing 210 (FIG. 20), preferably in a releasable fashion. When the cover 312 is mounted in position as illustrated in FIG. 15, it is generally coextensive with the aft end 202 and is engageable with the ribbon cable 42 to prevent movement of the ribbon cable relative to the housing. As seen especially in FIGS. 20 and 29, the cover includes a plurality of transversely extending parallel slots or grooves 314 appropriately spaced so that each of the slots or grooves can engageably receive one of the conductors of the ribbon cable 42 when the cover is mounted on the aft end 202. According to one suitable design for releasably mounting the cover 312 to the housing 210, the cover 312 includes spaced apart sidewalls 316 (FIG. 29) which are generally coextensive with the sidewalls of the housing 210 when the cover is mounted on the aft end 312 as seen in FIG. 15. A bracket 318 is integral with the cover 312 at each sidewall 316 and extends forwardly from each of the sidewalls. The extremeties of the brackets 318 are resilient and laterally moveable relative to the cover 312. Additionally, each of the brackets has an aperture 320 therein (see FIG. 20).

Figure 18:
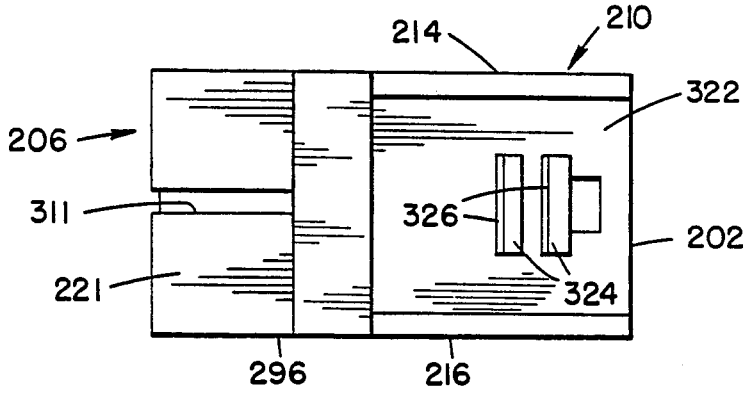
Figure 17:
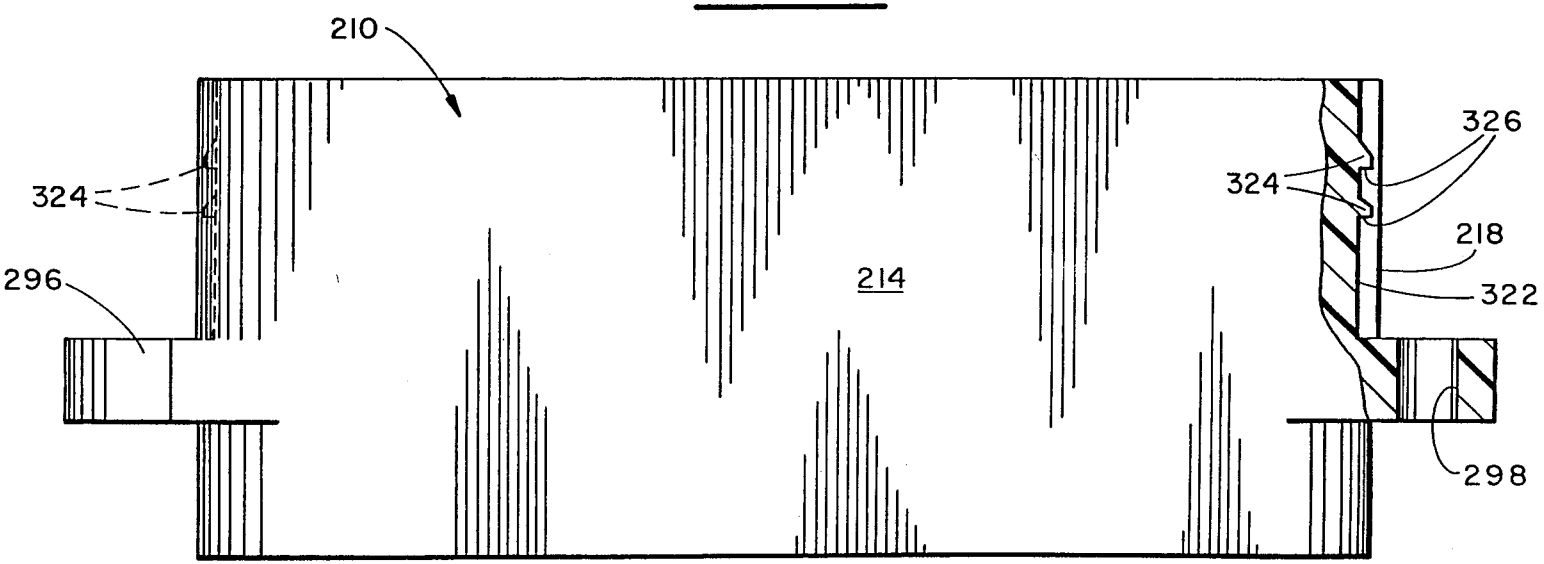
Figure 19:
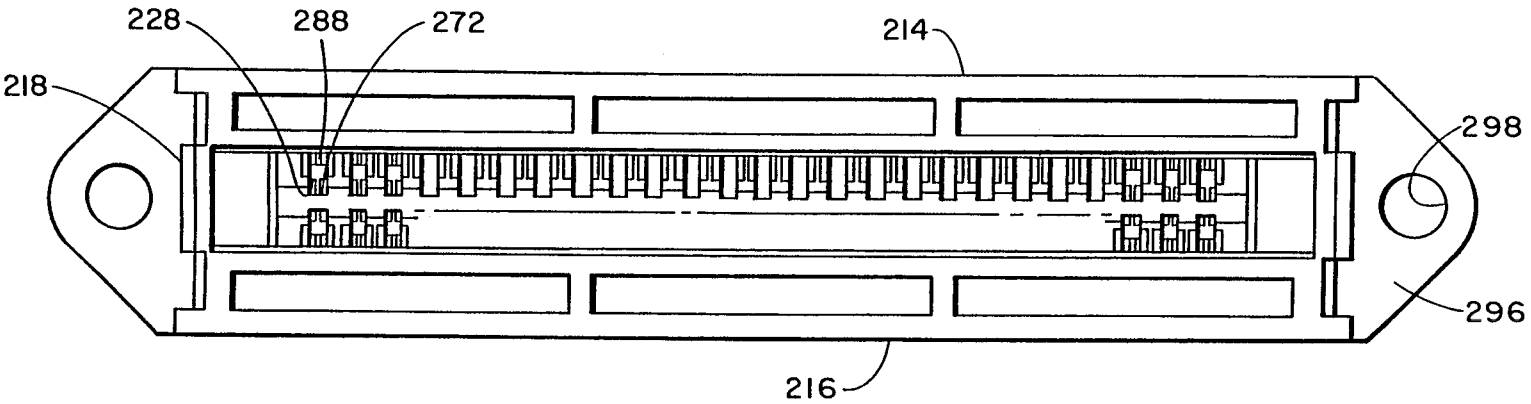

As seen in FIGS. 17 and 18, each of the sidewalls 316 has a recessed surface 322 to engageably receive the bracket 318. A pair of spaced ramped projections 324 extend outwardly from a central region of the recessed surface 322 and has an outer surface which slopes outwardly from the surface 322 with increasing distance from the aft end 202 toward the forward end 206, then terminates abruptly at laterally extending ledges 326. The use of two locking projections are intended to provide a convenience feature to the installer. With the round conductor flat cable manually aligned with the piercing elements of the I.D.C. tails, the installation cover is applied in the upper staged position, which applies sufficient interference with the cable to hold it in position and remain properly aligned should it be necessary to transport the connector cable assembly to another location for final termination. The lower projections provide the final locking surfaces at full termination. Each bracket 318 can be laterally flexed relative to the main body of the cover 312.

As seen especially in FIG. 15, the aperture 320 is adapted to engageably receive therein the associated projection 324 when the cover 312 is moved into its operating position. Specifically, the brackets 318 are caused to ride up the outer surfaces of the projections 324 as the cover is being mounted on the housing 210 until, with further movement of the cover 312 into engagement with the housing, the ledges 326 are caused to enter into the aperture 320. Being of resilient material, the brackets 318 are biased into contiguous relationship against the received surface 322. Furthermore, by reason of the ledges 326, inadvertent withdrawal of the cover 312 from the housing 210 is prevented.

It will be appreciated that it would be preferable to insert the electrical component 286 after the carrier member 250 and its associated contact arrays 234 are already positioned within the housing 210. Thereafter, the brackets would be attached to the assembly. However, in the event it is not desired to incorporate the electrical component 286 into the assembly, then neither it nor the brackets would be inserted but all other items described would be assembled in the manner described.

As seen in FIGS. 20 and 21, the housing 210 includes identical but mirror imaged upper and lower levels. The conductive members 236 are positioned in an upper level and in a lower level, a full array 234 being positioned at each level. However, it will be appreciated that while the first contact members 270 of the upper level array are laterally aligned with those of the lower level array, the tails 278 of the upper level are laterally offset relative to the tails of the second level such that the tails of one level are equidistant from adjacent ones of the tails of the second level. In this fashion, then, every second conductor of the ribbon cable is caused to engage with every second tail 278 of an array at a given level within the housing 210. Similarly, every other conductor of the ribbon cable will engage with every other tail 278 of the array at another level, but successive conductors of the ribbon cable will engage, in turn, tail 278 at one level then a tail 278 at the other level. In this manner, while the spacing between tails of a single array 234 may be, for example, 0.100 inches, the lateral distance between successive tails of the two sets of arrays may be, for example, only 0.050 inches, or equivalent to the pitch of the ribbon cable 42.

While the preferred embodiments of the invention have been disclosed in detail, it should be understood by those skilled in the art that various modifications may be made to the illustrated embodiment without departing from the scope as described in the specification and defined in the appended claims.

We claim:

1. A preformed electrical contact array formed from electrically conductive sheet material for insertion as a unit into a protective insulative housing comprising:

a plurality of generally equally spaced elongated laterally disposed electrically conductive members of flexible spring material including parallel forward members having a first predetermined pitch, parallel aft members having a second predetermined pitch different from said first predetermined pitch, and non-parallel transition members interconnecting said forward members and said aft members;

said transition members lying collectively in a plane, each of said transition members supportively engaged by a central element of the housing; and each of said forward members being formed with an undulation relative to the plane of said transition members and terminating at a support tab engageable with a forward supporting surface of the housing, said undulation defining a nose shaped first contact member located immediately aft of said support tab, said first contact member being biased in a direction transverse of the plane of said transition members when said contact array is fully inserted in the housing.

2. A preformed electrical contact array as set forth in claim 1 wherein:

each of said forward members includes a nose shaped first contact member adapted to engage a respective contact of a multiple contact plug; and wherein each of said aft members includes a bifurcated tail including a pair of spaced apart piercing prongs separated by a longitudinally extending conductor receiving slot, each of said prongs being formed with an entry edge adjacent the opening into the slot to guide a transversely extending conductor of multiple conductor ribbon cable into the slot when the conductor is moved transversely of its longitudinal axis toward said forward member.

3. A preformed electrical contact array as set forth in claim 1 wherein each of said forward members includes:

an aft facing push surface adjacent said transition member extending out of a plane thereof and engageable by a tool for advancing said array into the housing in a direction toward said support tab; and an aft facing locking tab proximate to said push surface extending out of the plane of said transition member in a direction opposite that of said push surface and adapted to engage a stop surface of the housing to prevent the inadvertent withdrawal of said conductive member from the housing in a direction away from said support tab.

4. A preformed electrical contact array as set forth in claim 1 wherein each of said aft members includes:

a substantially planar portion adapted to engage an outer supporting surface of the housing;

an active spring member integral with said planar portion and extending out the plane of said planar portion in a direction away from the outer supporting surface and having a free end facing said forward member and terminating at a second contact member adapted to engage a laterally extending electrical component within the housing; and said planar portion terminating at a bifurcated tail including a pair of spaced apart piercing prongs separated by a longitudinally extending conductor receiving slot, each of said prongs formed with an entry edge adjacent the opening into the slot to guide a transversely extending conductor into the slot when the conductor is moved transversely of its longitudinal axis toward said forward members.

5. A preformed electrical contact array as set forth in claim 1 wherein each of said forward members includes:

a first support region distant from said support tab adapted to contiguously engage a supporting surface of an electrically insulative carrier member.

6. A preformed electrical contact array as set forth in claim 1 including:

a removable primary carry strip extending transversely of said conductive members and integral with extremities of said forward members to initially support and hold said forward members equally spaced.

7. A preformed electrical contact array as set forth in claim 6 including:

a removable secondary carry strip extending transversely of said conductive members and integral with each of said conductive members intermediate said transition members and said aft members to initially support and hold said aft members equally spaced.

8. A preformed electrical contact array as set forth in claim 1 wherein each of said forward members includes:

an aft facing push surface adjacent said transition member extending out of a general plane thereof and engageable by a tool for advancing said array into the housing in a direction toward said support tab;

an aft facing locking tab proximate to said push surface extending out of the general plane of said transition member in a direction opposite that of said push surface and adapted to engage a stop surface of the housing to prevent the inadvertent withdrawal of said conductive member from the housing in a direction away from said support tab; and wherein each of said aft members includes:

a substantially planar portion adapted to contiguously engage an outer supporting surface of the housing; and an active spring member integral with said planar portion and extending out of the plane of said planar portion in a direction away from the outer supporting surface and having a free end facing said forward members and terminating at a second contact member adapted to engage a laterally extending electrical component mounted within the housing;

said planar portion terminating at a bifurcated tail including a pair of spaced apart piercing prongs separated by a longitudinally extending conductor receiving slot, each of said prongs being formed with an entry edge adjacent the opening into the slot to guide a transversely extending conductor into the slot when the conductor is moved transversely of its longitudinal axis toward said forward members.

9. A preformed electrical contact array as set forth in claim 8 wherein said transition members and said aft members lie in substantially parallel planes and wherein each of said conductive members includes a jog element joining said transition member and said aft member, said jog element lying in a plane transverse to the planes, respectively, of said transition member and said aft member.

10. A preformed electrical contact array as set forth in claim 9 wherein each of said conductive members has an outer surface and an inner surface such that when array has been fully inserted into the housing, said outer surface of each of said support tabs engages its associated forward supporting surface of the housing, said inner surface of each of said transition members engages its associated intermediate supporting surface of the housing, and said outer surface of each of said planar portions contiguously engages its associated outer supporting surface of the housing.

11. An electrical connector adapted to connect at one end a plurality of equally spaced contacts having a first predetermined pitch and at an opposite end a plurality of equally spaced contacts having a second predetermined pitch different from said first predetermined pitch, the combination comprising:

an elongated housing including a top, bottom, and sidewalls thereof and a central element within said housing extending from said sidewalls intermediate said top and said bottom, said housing having a forward end defining a forward cavity therein for engageably receiving a mating multiple contact connector and an aft end defining an aft cavity therein and having an intermediate cavity interconnecting the forward cavity and the aft cavity, said central element including a forward supporting surface within the forward cavity; an inner supporting surface within the aft cavity; a ramp extending from said inner supporting surface into the intermediate cavity sloped toward said housing with increasing distance from the aft cavity; and a stop surface which extends transverse to a plane of said ramp; said ramp terminating at a crest defined by an intersection between said ramp and said stop surface;

said housing including an outer supporting surface within the aft cavity spaced from said inner supporting surface;

a plurality of generally equally spaced elongated laterally disposed electrically conductive members of flexible spring materials having upper and lower surfaces and including parallel forward members having a first predetermined pitch, parallel aft members having a second predetermined pitch different from said first predetermined pitch, and non-parallel transition members interconnecting said forward members and said aft members;

said transition members lying collectively in a plane, each of said transition members supportively engaged by said central element; and each of said forward members being formed with an undulation relative to a plane of said transition members and terminating at a support tab engageable with said forward supporting surface, said undulation defining a nose shaped first contact member located immediately aft of said support tab, said first contact member being biased in a direction transverse of the plane of said transition members;

each of said forward members including:

an aft facing push surface adjacent said transition member extending out of a plane thereof and engageable by a tool for advancing said array into said housing in a direction toward said support tab; and an aft facing locking tab proximate to said push surface extending out of the plane of said transition member in a direction opposite that of said push surface and engaged with said stop surface to prevent the inadvertent withdrawal of said conductive member from the housing in a direction away from said support tab; and each of said aft members including:

a substantially planar portion engaged with said outer supporting surface and terminating at a bifurcated tail including a pair of spaced apart piercing prongs having oppositely facing longitudinally extending edges defining a conductor receiving slot, each of said prongs formed with a divergent entry edge adjacent the opening into the slot and facing outwardly of the aft cavity to guide a transversely extending conductor into the slot when the conductor is moved transversely of its longitudinal axis toward said forward members.

12. An electrical connector as set forth in claim 11 wherein each of said conductive members includes:

a jog element joining said transition member and said aft member, said jog element lying in a plane transverse to the planes, respectively, of said transition member and said aft member;

and wherein each of said aft members includes:

an active spring member integral with said planar portion and biased out of the plane of said planar portion in a direction away from said outer supporting surface and terminating at a second contact member adapted to engage a laterally extending electrical component mounted on said inner supporting surface.

13. An electrical connector as set forth in claim 11 wherein said elongated housing includes similar but mirror-imaged upper and lower levels, said central element being common to each of said levels, a first plurality of said electrically conductive members being located in said upper level and a second plurality of said electrically conductive members being located in said lower level, said first contact members of said first and second pluralities being transversely aligned and said tails of said first plurality being laterally offset relative to said tails of said second plurality, said tails of said first plurality being equidistant from adjacent ones of said tails of said second pluraity, said electrical connector being adapted to engageably receive and join with a plurality of individual conductors of multiple conductor ribbon cable extending transverse of said aft end of said housing such that when each individual conductor of the ribbon cable is aligned with an associated conductor receiving slot in said aft member of one of said conductive members and the ribbon cable is moved toward said connector, each individual conductor of the ribbon cable is guided by said entry edges into its associated slot and is electrically joined to said conductive member, said connector includng a cover releasably mounted to said aft end and generally coextensive therewith and engageable with the ribbon cable to prevent movement of the ribbon cable relative to said housing.

14. An electrical connector as set forth in claim 11 wherein said outer and inner supporting surfaces lie in substantially parallel planes and wherein said planar portion includes:

an active spring member integral therewith and biased out of the plane thereof in a direction away from said outer supporting surface and having a free end facing said forward members and terminating at a second contact member;

said connector including:

an elongated laterally extending electrical component supported on said inner supporting surface and having a plurality of spaced third contact members thereon, each of said second contact members being biased into engagement with each of said third contact members.

15. An electrical connector as set forth in claim 14 wherein said electrical component is a capacitor filter array.

16. An electrical connector as set forth in claim 14 including:

an elongated electrically conductive grounding bracket extending along said aft end;

means for mounting said grounding bracket on said housing and at least one finger contact integral with said grounding bracket biased into engagement with said electrical component.

17. An electrical connector as set forth in claim 14 wherein said housing includes:

mounting ears extending outwardly from said sidewalls, each of said mounting ears having a first hole therethrough adapted to receive a fastener for mounting said connector;

said connector including an elongated electrically conductive grounding bracket having a central member extending along said aft end and having a plurality of finger contacts biased into engagement with said electrical component;

a pair of integral legs extending transverse thereof and a pair of integral feet extending generally parallel with said central member and contiguous with said mounting ears, each of said feet having a second hole therein coextensive with the first hole;

whereby when said grounding bracket is mounted on said connector, said legs are positioned, respectively, contiguous with said sidewalls and said feet are positioned respectively, contiguous with said mounting ears; and means for mounting said grounding bracket on said housing.

18. An electrical connector as set forth in claim 17 wherein each of said sidewalls is formed with a ramped projection having an outer surface which slopes outwardly from the surface of said sidewall with increasing distance from said aft end toward said forward end and terminating abruptly at a laterally extending ledge, wherein said grounding bracket is formed of spring material, and wherein each of said legs has an aperture adapted to engageably receive therein its associated one of said projections, said legs caused to ride up said outer surfaces of said projections as said grounding bracket is being mounted on said housing until with further movement of said bracket toward said housing said ledge is caused to enter into the aperture, said legs being biased into contiguous relationship against said sidewalls and said feet being biased into contiguous relationship against said mounting ears.

19. An electrical connector as set forth in claim 11 adapted to engageably receive and join with a plurality of individual conductors of multiple conductor ribbon cable extending transverse of said aft end of said housing such that when each individual conductor of the ribbon cable is aligned with an associated conductor receiving slot in said aft member of one of said conductive members and the ribbon cable is moved toward said connector, each individual conductor of the ribbon cable is guided by said entry edges into its associated slot and is electrically joined to said conductive member, said connector including a cover releasably mounted to said aft end and generally coextensive therewith and engageable with the ribbon cable to prevent movement of the ribbon cable relative to said housing.

20. An electrical connector as set forth in claim 19 wherein said tails of said conductive members extend beyond said aft end and wherein said cover includes a laterally extending depression therein positioned to loosely receive said tails therein when said cover is mounted on said aft end.

21. An electrical conductor as set forth in claim 19 wherein the width of the slot between said piercing prongs is less than the nominal diameter of the conductors of the ribbon cable and such that as a conductor is introduced into an associated one of the slots, said longitudinally extending edges displace the protective sheath on the ribbon cable enabling electrical contact to be made between said prongs and the conductor.

22. An electrical connector as set forth in claim 19 including means for releasably mounting said cover to said aft end, said cover including a plurality of transversely extending parallel slots appropriately spaced such that each of said slots can engageably receive one of the conductors of the ribbon cable when said cover is mounted on said aft end.

23. An electrical connector as set forth in claim 22 wherein said cover mounting means includes a plurality of outwardly extending tapered pins on said cover frictionally engageable with mating tapered bores in said aft end.

24. An electrical connector as set forth in claim 11 wherein said elongated housing includes identical but mirror-imaged upper and lower levels, said central element being common to each of said levels, a first plurality of said electrically conductive members being located in said upper level and a second plurality of said electrically conductive members being located in said lower level, said first contact members of said first and second pluralities being transversely aligned and said tails of said first plurality being laterally offset relative to said tails of said second plurality.

25. An electrical connector as set forth in claim 24 wherein said tails of said first plurality are equidistant from adjacent ones of said tails of said second plurality.

26. An electrical connector as set forth in claim 24 including first and second elongated laterally extending electrical components supported on said inner supporting surfaces within said first and second levels respectively, said first and second components each having a plurality of spaced third contact members thereon, each of said second contact members of said first plurality and of said second plurality being biased into engagement with each of said third contact members on said first and second components, respectively.

27. An electrical connector as set forth in claim 26 wherein each of first and second electrical components is a capacitor filter array.

28. An electrical connector as set forth in claim 26 including:

an elongated electrically conductive grounding bracket extending along said aft end;

means for mounting said grounding bracket or said housing; and a plurality of finger contacts integral with said grounding bracket biased into engagement with said first and second electrical components.

29. An electrical connector as set forth in claim 26 wherein:

said housing includes mounting ears extending outwardly from said sidewalls, each of said mounting ears having a first hole therethrough adapted to receive a fastener for mounting said connector, said connector including an elongated conductive grounding bracket having a central member extending along said aft end and having a plurality of finger contacts biased into engagement with said first and second electrical components, a pair of integral legs extending transverse thereof and a pair of integral feet extending generally parallel with said central member, each of said feet having a second hole therein coextensive with the first hole;

whereby when said grounding bracket is mounted on said connector, said legs are positioned, respectively, contiguous with said sides and said feet are positioned, respectively, contiguous with said mounting ears; and means for mounting said grounding bracket on said housing.

30. An electrical connector as set forth in claim 29 wherein each of said sidewalls is formed with a ramped projection having an outer surface which slopes outwardly from the surface of said sidewall with increasing distance from said aft end toward said forward end and termination abruptly at a laterally extending ledge, wherein said grounding bracket is formed of spring material, and wherein each of said legs has an aperture adapted to engageably receive therein its associated one of said projections, said legs caused to ride up said outer surfaces of said projections as said grounding bracket is being mounted on said housing until with further movement of said bracket toward said housing said ledge is caused to enter into the aperture, said legs being biased into contiguous relationship against said sidewalls and said feet being biased into contiguous relationship against said mounting ears.

31. A preformed electrical contact array as set forth in claim 1 wherein each of said aft members includes:

a second support region adapted to contiguously engage a supporting surface of an electrically insulative carrier member; and a bifurcated tail adjacent said second support region and extending therefrom in a direction away from said forward member, said tail including a pair of spaced apart piercing prongs separated by a longitudinally extending conductor receiving slot, each of said prongs formed with an entry edge adjacent the opening into the slot to guide a transversely extending conductor into the slot when the conductor is moved transversely of its longitudinal axis toward said forward members.

32. A preformed electrical contact array as set forth in claim 31 wherein each of said transition members and each of said aft members are substantially coplanar.

33. A preformed electrical contact array as set forth in claim 1 wherein each of said forward members includes:

a first support region distant from said support tab adapted to contiguously engage an aft supporting surface of an electrically insulative carrier member; and wherein each of said aft members includes:

a second support region adapted to contiguously engage a supporting surface of an electrically insulative carrier member; and a bifurcated tail adjacent said second support region and extending therefrom in a direction away from said forward member, said tail including a pair of spaced apart piercing prongs separated by a longitudinally extending conductor receiving slot, each of said prongs being formed with an entry edge adjacent the opening into the slot to guide a transversely extending conductor into the slot when the conductor is moved transversely of its longitudinal axis toward said nose end.

34. A preformed electrical contact array as set forth in claim 33 wherein each of said conductive members has an outer surface and an inner surface such that when said array has been fully inserted into the housing, said outer surface of each of said support tabs engage its associated forward supporting surface of the housing, and said inner surface of each of said first and second support regions contiguously engages its associated supporting surface of the carrier member.

35. An electrical connector adapted to connect at one end a plurality of equally spaced contacts having a first predetermined pitch and at an opposite end a plurality of equally spaced contacts having a second predetermined pitch different from said first predetermined pitch, the combination comprising:

an elongated housing including a top, bottom, and sidewalls thereof, and a central element within said housing extending from said sides intermediate said top and said bottom, said housing having a forward end defining a forward cavity therein for engageably receiving a multiple contact plug and an aft end defining an aft cavity therein and having an intermediate cavity interconnecting the forward cavity and the aft cavity, said central element including a forward supporting surface within the forward cavity;

an electrically insulative carrier member having a supporting surface thereon and fittingly receivable within the second cavity;

a plurality of generally equally spaced elongated laterally disposed electrically conductive members of flexible spring material mounted on said carrier member, and extending through the cavities of said housing, each of said conductive members having outer and inner surfaces and including parallel forward members having a first predetermined pitch, parallel aft members having a second predetermined pitch different from said first predetermined pitch, and non-parallel transition members lying collectively in a plane and interconnecting said forward members and said aft members;

each of said forward members including:

an undulation relative to a plane of said transition members and terminating at a support tab engageable with said forward supporting surface, said undulation defining a nose shaped first contact member located immediately aft of said support tab, said first contact member being biased in a direction transverse of the plane of said transition members; and a first support region distant from said support tab adapted to contiguously engage one of said supporting surface of said carrier member; and each of said aft members including:

a second support region adapted to contiguously engage said supporting surface of said carrier member; and a bifurcated tail adjacent said second support region and extending therefrom in a direction away from said forward member, said tail including a pair of spaced apart piercing prongs having oppositely facing longitudinally extending edges defining a conductor receiving slot, each of said prongs formed with a divergent entry edge adjacent the opening into the slot and facing outwardly of the aft cavity to guide a transversely extending conductor into the slot when the conductor is moved transversely of its longitudinal axis toward said forward members.

36. An electrical connector as set forth in claim 35 wherein each of said forward members inclues: an active spring member integral therewith intermediate said undulation and said first support region and extending out of the general plane thereof and terminating at a second contact member adapted to engage a laterally extending electrical component mounted within the intermediate cavity.

37. An electrical connector as set forth in claim 35 wherein said elongated housing includes identical but mirror-imaged upper and lower levels, said central element being common to each of said levels, a first plurality of said electrically conductive members being located in said upper level and a second plurality of said electrically conductive members being located in said lower level, said first contact members of said first and second pluralities being transversely aligned and said tails of said first plurality bring laterally offset relative to said tails of said second plurality, said tails of said first plurality bing equidistant from adjacent ones of said tails of said second plurality, said electrical connector being adapted to engageably receive and join with a plurality of individual conductors of multiple conductor ribbon cable extending transverse of said aft end of said housing such that when each individual conductor of the ribbon cable is aligned with an associated conductor receiving slot in said aft member of one of said conductive members and the ribbon cable is moved toward said connector, each individual conductor of the ribbon cable is guided by said entry edges into its associated slot and is electrically joined to said conductive member, said connector including a cover releasably mounted to said aft end and generally coextensive therewith and engageable with the ribbon cable to prevent movement of the ribbon cable relative to said housing.

38. An electrical connector as set forth in claim 35 wherein said central element terminates at a stop surface adjacent the intermediate cavity and wherein each of said forward members includes:

an active spring member integral therewith intermediate said undulation and said first support region and extending out of the general plane thereof and having a free end facing away from said support tab and terminating at a second contact member;

said housing including:

a plurality of parallel spaced ribs within the intermediate cavity extending fore and aft and transversely relative to said top and said bottom and collectively defining a slot for the loose reception therein of an electrical component; and said connector including:

an elongated laterally extending electrical component loosely received within the slot defined by said ribs and abuttingly engaging said stop surface and having a plurality of spaced third contact members thereon, each of said second contact members being biased into engagement with an associated one of said third contact members.

39. An electrical connector as set forth in claim 38 wherein said electrical component is a capacitor filter array.

40. An electrical connector as set forth in claim 38 including electrically conductive grounding means mounted on said housing and engageable with said electrical component.

41. An electrical connector as set forth in claim 38 including a pair of laterally spaced grounding brackets mounted on said housing and including fourth contact members biased into engagement with opposed ends of said electrical component.

42. An electrical connector as set forth in claim 38 wherein said housing has a forward face and a pair of laterally spaced slots open at said face and extending rearwardly thereof; and including:

an electrically conductive grounding bracket loosely received in each of the slots and including spring biased finger elements engageable with said housing to prevent removal thereof when said bracket is fully inserted into the slot;

fourth contact members integral with said grounding bracket biased into engagement with opposite ends of said electrical component.

43. An electrical connector as set forth in claim 38 wherein ssaid housing includes:

mounting ears extending outwardly from said sidewalls, each of said mounting ears having a first hole therethrough adapted to receive a fastener for mounting said connector; and a forward face having a pair of laterally spaced slots open at said face and extending rearwardly thereof and communicating with the intermediate cavity;

said connector including:

an electrically conductive grounding bracket loosely received in each of the slots;

said bracket including:

leg members having spring biased latches engageable with said housing to prevent removal thereof when said bracket is fully inserted into the slot;

fourth contact members integral with said leg members and biased into engagement with said electrical component when said bracket is fully inserted into the slot; and an integral foot extending transversely of said leg members and contiguous with said mounting ears when said bracket is fully inserted into the slot, each of said feet having a second hole therein coextensive with the first hole.

44. An electrical connector as set forth in claim 43 wherein each of said sidewalls is formed with a ramped projection having an outer surface which slopes outwardly from the surface of said sidewall with increasing distance from said aft end toward said forward end and terminates abruptly at a laterally extending ledge wherein said cover includes:

spaced apart sidewalls generally coextensive with said sidewalls of said housing when said cover is mounted on said aft end; and a bracket integral therewith extending outwardly from each of said sidewalls, said brackets having extremeties which are resilient and laterally movable relative to said cover, each of said brackets having an aperture adapted to engageably receive therein its associated one of said projections, said brackets being caused to ride up said outer surfaces of said projections as said cover is advanced toward said aft end, until, with further movement of said bracket toward said aft end, said ledge is caused to enter into the aperture, said brackets being biased into contiguous relationship against said sidewalls, said cover being held against removal from said housing by reason of said brackets engaging said corresponding ledges.

45. An electrical connector as set forth in claim 35 adapted to engageably receive and join with a plurality of individual conductors of multiple conductor ribbon cable extending transverse of said aft end of said housing such that when each individual conductor of the ribbon cable is aligned with an associated conductor receiving slot in said aft member of one of said conductive members and the ribbon cable is moved toward said connector, each individual conductor of the ribbon cable is guided by said entry edges into its associated slot and is electrically joined to said conductive member, said connector including a cover releasably mounted to said aft end and generally coextensive therewith and engageable with the ribbon cable to prevent movement of the ribbon cable relative to said housing.

46. An electrical connector as set forth in claim 45 including means for releasably mounting said cover to said aft end, said cover including a plurality of transversely extending parallel slots appropriately spaced such that each of said slots can engageably receive one of the conductors of the ribbon cable when said cover is mounted on said aft end.

47. An electrical connector as set forth in claim 45 wherein said tails of said conductive members extend beyond said aft end and wherein said cover includes a laterally extending depression therein positioned to loosely receive said tails therein when said cover is mounted on said aft end.

48. An electrical conductor as set forth in claim 45 wherein the width of the slot between said piercing prongs is less than the nominal diameter of the conductors of the ribbon cable such that as a conductor is introduced into an associated one of the slots, said longitudinally extending edges displace the protective sheath on the ribbon cable enabling electrical contact to be mde between said prongs and the conductor.

49. An electrical connector as set forth in claim 35 wherein said elongated housing includes identical but mirror-imaged upper and lower levels, said central element being common to each of said levels, a first plurality of said electrically conductive members being located in said upper level and a second plurality of said electrically conductive members being located in said lower level, said first contact members of said first and second pluralities being transversely aligned and said tails of said first plurality being laterally offset relative to said tails of said second plurality.

50. An electrical connector as set forth in claim 49 wherein said tails of said first plurality are equidistant from adjacent ones of said tails of said second plurality.

51. An electrical connector as set forth in claim 49 including an elongated laterally extending electrical component received within the intermediate cavity, said electrical component having a plurality of spaced third contact members thereon, each of said second contact members of said first plurality and of said second plurality being biased into engagement with an associated one of said third contact members.

52. An electrical connector as set forth in claim 51 wherein said electrical component is a capacitor filter array.

53. An electrical connector as set forth in claim 51 wherein said housing has a forward face and a pair of laterally spaced slots open at said face and extending rearwardly thereof; and including:

an elongated electrically conductive grounding bracket loosely received in each of the slots and including spring biased finger elements engageable with said housing to prevent removal thereof when said bracket is fully inserted into the slot; and fourth contact members integral with said grounding bracket biased into engagement with opposite ends of said electrical component.

54. An electrical connector as set forth in claim 51 wherein said housing includes:

mounting ears extending outwardly from said sidewalls, each of said mounting ears having a first hole therethrough adapted to receive a fastener for mounting said connector; and a forward face having a pair of laterally spaced slots open at said face and extending rearwardly thereof and communicating with the intermediate cavity;

said connector including an electrically conductive grounding bracket loosely received in each of the slots;

said bracket including:

spring biased latches engageable with said housing to prevent removal thereof when said bracket is fully inserted into the slot;

fourth contact members integral therewith and biased into engagement with said electrical component when said bracket is fully inserted into the slot; and a pair of integral feet extending generally parallel with said central member and contiguous with said mounting ears, each of said feet having a second hole therein coextensive with the first hole.

55. An electrical connector as set forth in claim 54 wherein each of said sidewalls is formed with a ramped projection having an outer surface which slopes outwardly from the surface of said sidewall with increasing distance from said aft end toward said forward end and terminates abruptly at a ledge wherein said cover includes:

spaced apart sidewalls generally coextensive with said sidewalls of said housing when said cover is mounted on said aft end; and a bracket integral therewith extending outwardly from each of said sidewalls, said brackets having extremeties which are resilient and laterally movable relative to said cover, each of said brackets having an aperture adapted to engageably receive therein its associated one of said projections, said brackets being caused to ride up said outer surfaces of said projections as said cover is advanced toward said aft end, until, with further movement of said bracket toward said aft end, said ledge is caused to enter into the aperture, ssaid brackets being biased into contiguous relationship against said sidewalls, ssaid cover being held against removal from said housing by reason of said brackets engaging said corresponding ledges.

* * * * *